US011807974B2

(12) United States Patent
Cooke et al.

(10) Patent No.: US 11,807,974 B2
(45) Date of Patent: Nov. 7, 2023

(54) METHODS AND DEVICES FOR INDIVIDUALIZED LAUNDRY

(71) Applicant: Conopco, Inc., Englewood Cliffs, NJ (US)

(72) Inventors: Deborah Jane Cooke, Chester (GB); David Moorfield, Buckley (GB); Katharine Jane Shaw, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 43 days.

(21) Appl. No.: 16/652,874

(22) PCT Filed: Sep. 20, 2018

(86) PCT No.: PCT/EP2018/075452
§ 371 (c)(1),
(2) Date: Apr. 1, 2020

(87) PCT Pub. No.: WO2019/068472
PCT Pub. Date: Apr. 11, 2019

(65) Prior Publication Data

US 2020/0248352 A1 Aug. 6, 2020

(30) Foreign Application Priority Data

Oct. 5, 2017 (EP) ..... 17194986
Dec. 11, 2017 (EP) ..... 17206467

(51) Int. Cl.
*D06F 33/37* (2020.01)
*D06F 34/32* (2020.01)
(Continued)

(52) U.S. Cl.
CPC ..... *D06F 33/37* (2020.02); *D06F 33/32* (2020.02); *D06F 34/32* (2020.02); *D06F 34/05* (2020.02);
(Continued)

(58) Field of Classification Search
CPC ..... D06F 33/37; D06F 2105/42
See application file for complete search history.

(56) References Cited

U.S. PATENT DOCUMENTS 3,094,247 A 6/1963 Marchi
4,893,942 A 1/1990 Stottmann
(Continued)

FOREIGN PATENT DOCUMENTS

AU 13548 9/1988
CN 1387563 12/2002
(Continued)

OTHER PUBLICATIONS

Written Opinion 2 in PCTEP2019054368.; dated Jan. 24, 2020.
(Continued)

*Primary Examiner* — Spencer E. Bell
(74) *Attorney, Agent, or Firm* — Carter, DeLuca & Farrell LLP; George Likourezos; Bret P. Shapiro

(57) ABSTRACT

A computer-implemented method for creating a bespoke laundry treatment recipe includes receiving fabric data related to one or more of stain identity, fabric identity, user requirements and user preference; comparing by means of a data processing system said input data with ingredient combination data stored on a non-transitory computer readable storage medium, and formulating one or more laundry treatment recipes, said recipes being bespoke to the user input data; wherein said ingredient combination data comprises: multiple ingredient composition data; multiple combinations of said ingredient compositions; and multiple treatment (e.g. stain) categories related to said ingredient composition combinations.

7 Claims, 8 Drawing Sheets

Figure 1:
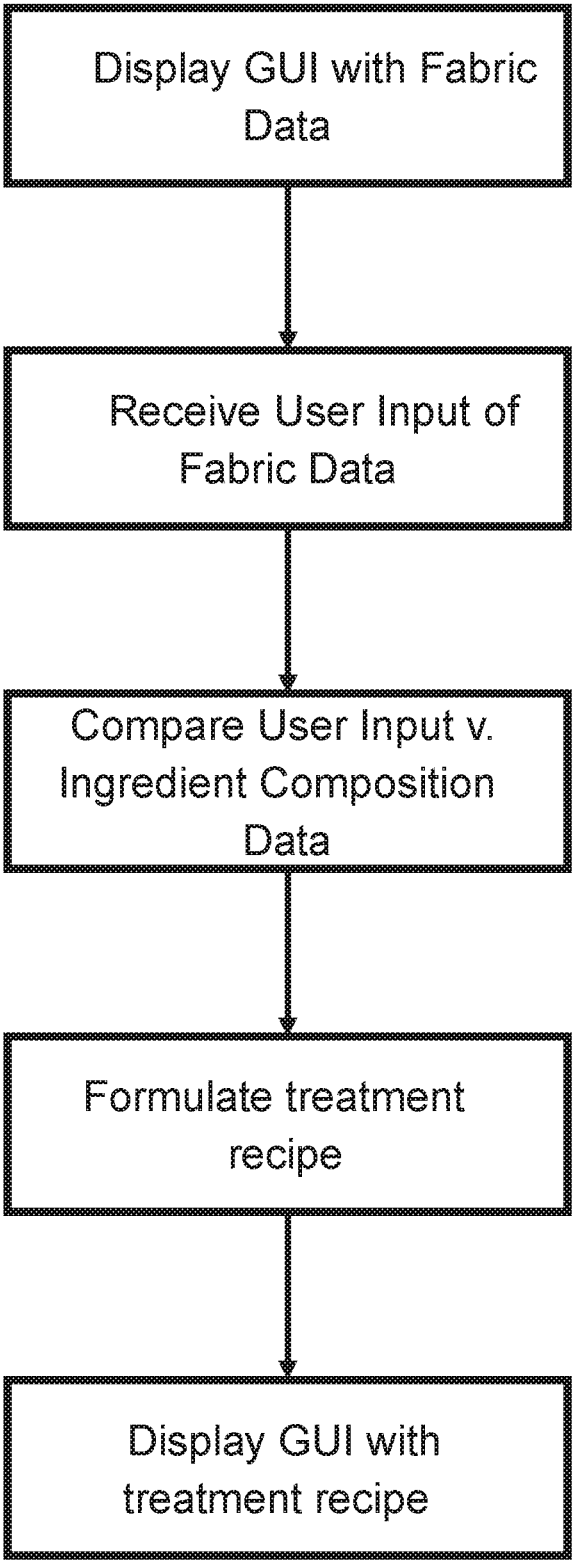

(51) Int. Cl.

| | |
|---|---|
| ***D06F 33/32*** | (2020.01) |
| ***D06F 105/42*** | (2020.01) |
| ***D06F 101/06*** | (2020.01) |
| ***D06F 34/05*** | (2020.01) |
| ***D06F 105/58*** | (2020.01) |
| ***D06F 101/20*** | (2020.01) |
| ***D06F 39/02*** | (2006.01) |
| ***D06F 34/30*** | (2020.01) |
| ***D06F 101/02*** | (2020.01) |

(52) U.S. Cl.

CPC ..... *D06F 34/30* (2020.02); *D06F 39/02* (2013.01); *D06F 2101/02* (2020.02); *D06F 2101/06* (2020.02); *D06F 2101/20* (2020.02); *D06F 2105/42* (2020.02); *D06F 2105/58* (2020.02)

(56) References Cited

U.S. PATENT DOCUMENTS

| | | | |
|---|---|---|---|
| 4,901,074 | A | 2/1990 | Sinn et al. |
| 4,932,227 | A | 12/1990 | Hogrefe |
| 5,861,371 | A | 1/1999 | Wilsch-Irrgang |
| 5,897,671 | A | 4/1999 | Newman et al. |
| 5,942,485 | A | 8/1999 | Kemen |
| 5,974,303 | A | 10/1999 | Krause |
| 6,349,440 | B1 | 2/2002 | Amberg et al. |
| 7,046,230 | B2 | 5/2006 | Zadesky et al. |
| 8,631,972 | B2 | 1/2014 | Kessler et al. |
| 9,469,933 | B2 | 10/2016 | Miller |
| 9,949,612 | B2 | 4/2018 | Lonski |
| 10,240,274 | B2 | 3/2019 | Miller |
| 2001/0049846 | A1 | 12/2001 | Guzzi et al. |
| 2002/0077265 | A1 | 6/2002 | Buzzacarini et al. |
| 2003/0075237 | A1 | 4/2003 | Bettiol et al. |
| 2003/0154560 | A1 | 8/2003 | Behrens et al. |
| 2003/0216274 | A1 | 11/2003 | Del Duca et al. |
| 2004/0147416 | A1 | 7/2004 | Woo |
| 2005/0033647 | A1 | 2/2005 | Crisp, III |
| 2005/0102767 | A1 | 5/2005 | Aouad et al. |
| 2005/0106192 | A1 | 5/2005 | Parekh et al. |
| 2005/0113282 | A1 | 5/2005 | Parekh et al. |
| 2005/0252533 | A1 | 11/2005 | Baeck et al. |
| 2006/0102656 | A1 | 5/2006 | Troost et al. |
| 2006/0138169 | A1 | 6/2006 | Cafferty |
| 2006/0272360 | A1 | 12/2006 | Hsu et al. |
| 2007/0044820 | A1 | 3/2007 | Chan et al. |
| 2008/0276655 | A1 | 11/2008 | Luckman et al. |
| 2008/0276964 | A1 | 11/2008 | Hendrickson et al. |
| 2008/0276965 | A1 | 11/2008 | Aykroyd et al. |
| 2009/0044129 | A1 | 2/2009 | Ebrom et al. |
| 2009/0044137 | A1 | 2/2009 | Bartley et al. |
| 2009/0194562 | A1 | 8/2009 | Kessler et al. |
| 2009/0276101 | A1 | 11/2009 | Yankee et al. |
| 2010/0102076 | A1 | 4/2010 | Hendrickson et al. |
| 2010/0102082 | A1 | 4/2010 | Ebrom et al. |
| 2010/0163573 | A1 | 7/2010 | Wegelin et al. |
| 2011/0139818 | A1 | 6/2011 | Kessler et al. |
| 2011/0154864 | A1 | 6/2011 | Schulze |
| 2011/0174346 | A1 | 7/2011 | Kessler et al. |
| 2011/0290281 | A1 | 12/2011 | Kessler et al. |
| 2011/0315709 | A1 | 12/2011 | Fileccia et al. |
| 2012/0015858 | A1 | 1/2012 | Kessler et al. |
| 2012/0018451 | A1 | 1/2012 | Fileccia |
| 2012/0021965 | A1 | 1/2012 | Bastigkeit et al. |
| 2012/0031930 | A1 | 2/2012 | Feliccia et al. |
| 2012/0056827 | A1 | 3/2012 | Kim et al. |
| 2012/0088710 | A1 | 4/2012 | Kessler et al. |
| 2012/0204356 | A1 | 8/2012 | Bastigkeit et al. |
| 2012/0247158 | A1 | 10/2012 | Ditze et al. |
| 2012/0088709 | A1 | 12/2012 | Kessler et al. |
| 2013/0036775 | A1 | 2/2013 | Brueckner et al. |
| 2013/0042652 | A1 | 2/2013 | Brueckner et al. |
| 2013/0061404 | A1 | 3/2013 | Jenkins |
| 2013/0175293 | A1 | 7/2013 | Burgess |
| 2013/0263387 | A1* | 10/2013 | Aykroyd ..... D06F 34/08 8/137 |
| 2013/0263630 | A1 | 10/2013 | Doh et al. |
| 2013/0340178 | A1 | 12/2013 | Riesenberg et al. |
| 2014/0102153 | A1 | 4/2014 | Lee et al. |
| 2014/0304924 | A1 | 10/2014 | Van Den Bergh et al. |
| 2015/0330013 | A1 | 11/2015 | Miller |
| 2015/0368846 | A1 | 12/2015 | Del Pos et al. |
| 2015/0375900 | A1 | 12/2015 | Larson |
| 2016/0060800 | A1 | 3/2016 | Ghosh et al. |
| 2016/0289883 | A1 | 10/2016 | Lv et al. |
| 2017/0081616 | A1 | 3/2017 | Baltsen et al. |
| 2017/0107658 | A1 | 4/2017 | Bolton et al. |
| 2017/0292217 | A1 | 10/2017 | Kulkarni |
| 2018/0171531 | A1 | 6/2018 | Miller |
| 2019/0136162 | A1 | 5/2019 | Cooke et al. |
| 2019/0136439 | A1 | 5/2019 | Cooke |
| 2019/0136440 | A1 | 5/2019 | Clarke |
| 2019/0264364 | A1 | 8/2019 | Chatfield |
| 2019/0292710 | A1 | 9/2019 | Cooke |

FOREIGN PATENT DOCUMENTS

| | | |
|---|---|---|
| CN | 1401030 | 3/2003 |
| CN | 1954111 | 4/2007 |
| CN | 101302697 | 11/2008 |
| CN | 101302700 | 11/2008 |
| CN | 101794121 | 8/2010 |
| CN | 101886323 | 11/2010 |
| CN | 101886324 | 11/2010 |
| CN | 102571129 | 7/2012 |
| CN | 102883645 | 1/2013 |
| CN | 202744828 | 2/2013 |
| CN | 103485122 | 1/2014 |
| CN | 103726273 | 4/2014 |
| CN | 103924415 | 7/2014 |
| CN | 204211975 | 3/2015 |
| CN | 104652098 | 5/2015 |
| CN | 105143543 | 12/2015 |
| CN | 205258897 | 5/2016 |
| CN | 106192308 | 12/2016 |
| DE | 744406 | 1/1944 |
| DE | 102007041643 | 3/2009 |
| DE | 102008047941 | 3/2010 |
| DE | 102008053312 | 4/2010 |
| DE | 102009046546 | 5/2011 |
| DE | 10201003776 | 10/2011 |
| DE | 102010027991 | 10/2011 |
| DE | 102010028353 | 11/2011 |
| DE | 102010027993 | 5/2012 |
| DE | 102013018175 | 6/2015 |
| DE | 102016212981 | 1/2018 |
| DE | 102016212982 | 1/2018 |
| EP | 0299575 | 1/1989 |
| EP | 0368680 | 5/1990 |
| EP | 0387426 | 9/1990 |
| EP | 1041187 | 10/2000 |
| EP | 1088927 | 4/2001 |
| EP | 1317524 | 6/2003 |
| EP | 1318225 | 6/2003 |
| EP | 1468926 | 10/2004 |
| EP | 1212398 | 6/2006 |
| EP | 1728912 | 6/2006 |
| EP | 1990461 | 11/2008 |
| EP | 1995368 | 11/2008 |
| EP | 2065860 | 6/2009 |
| EP | 2141275 | 1/2010 |
| EP | 2180390 | 4/2010 |
| EP | 2314542 | 4/2011 |
| EP | 2642013 | 9/2013 |
| EP | 2913431 | 9/2015 |
| EP | 2939975 | 11/2015 |
| EP | 2955150 | 12/2015 |
| EP | 3130968 | 2/2017 |
| EP | 3176298 | 6/2017 |
| FR | 2612894 | 9/1988 |
| GB | 2437555 | 9/2008 |
| GB | 2468158 | 9/2010 |

(56) References Cited

FOREIGN PATENT DOCUMENTS

| | | |
|---|---|---|
| GB | 2581486 | 4/2013 |
| GB | WO2017176292 | 10/2017 |
| GB | WO2017205280 | 11/2017 |
| KR | 20100081221 | 7/2010 |
| WO | WO9115623 | 10/1991 |
| WO | WO9527037 | 10/1995 |
| WO | WO9709406 | 3/1997 |
| WO | WO0107095 | 2/2001 |
| WO | WO0196645 | 12/2001 |
| WO | WO0208371 | 1/2002 |
| WO | WO0220893 | 3/2002 |
| WO | WO2004101122 | 11/2004 |
| WO | WO2008008392 | 1/2008 |
| WO | WO2008016683 | 2/2008 |
| WO | WO2008074680 | 6/2008 |
| WO | WO2009022223 | 2/2009 |
| WO | WO2009033828 | 3/2009 |
| WO | WO2009094999 | 8/2009 |
| WO | WO2009095003 | 8/2009 |
| WO | WO2009117795 | 10/2009 |
| WO | WO2009153184 | 12/2009 |
| WO | WO2010007054 | 1/2010 |
| WO | WO2010031607 | 3/2010 |
| WO | WO2010067303 | 6/2010 |
| WO | WO2011042867 | 4/2011 |
| WO | WO2011128676 | 10/2011 |
| WO | WO2011131256 | 10/2011 |
| WO | WO2011134690 | 11/2011 |
| WO | WO2011138218 | 11/2011 |
| WO | WO2012084005 | 6/2012 |
| WO | WO2012118285 | 9/2012 |
| WO | WO2013054089 | 4/2013 |
| WO | WO2014031753 | 2/2014 |
| WO | WO2014079621 | 5/2014 |
| WO | WO2016173679 | 11/2016 |
| WO | WO2017042087 | 3/2017 |
| WO | WO2017067936 | 4/2017 |
| WO | WO2017211698 | 12/2017 |
| WO | WO2017211700 | 12/2017 |
| WO | WO2017211701 | 12/2017 |
| WO | WO2018011167 | 1/2018 |
| WO | WO2018011179 | 1/2018 |

OTHER PUBLICATIONS

Written Opinion in PCTEP2019052151; dated Jan. 14, 2020.
Written Opinion in PCTEP2019052152; dated Jan. 17, 2020.
IPRP2 in PCTEP2019052151; May 14, 2020.
IPRP2 in PCTEP2019052152; May 27, 2020.
Search Report and Written Opinion in PCTEP2018075439; dated Nov. 27, 2018.
Search Report and Written Opinion in PCTEP2018076486; dated Nov. 6, 2018.
Search Report and Written opinion in EP18155012; dated Jul. 13, 2018.
Search Report and Written Opinion in EP17206467; dated Jun. 19, 2018.
Search Report and Written Opinion in PCTEP2017072935; dated Nov. 16, 2017.
Search Report and Written Opinion in EP16193266; dated Mar. 29, 2017.
Search Report and Written Opinion in PCTEP2017063401; dated Aug. 31, 2017.
IPRP2 in PCTEP2018075452; Jan. 10, 2020.
Search Report and Written Opinion in PCTEP2018075452; dated Jan. 2, 2019.
Search Report 2 and Written Opinion 2 in PCTEP2018050562; dated Jul. 4, 2018; World Intellectual Property Org. (WIPO).
IPRP2 in PCTEP2017063403; Aug. 10, 2018.
Search Report and Written Opinion in EP18162886; dated Sep. 4, 2018.
IPRP2 in PCTEP2017063401; Jul. 23, 2018.
Search Report and Written Opinion in EP17194249; dated Mar. 26, 2018.
Written Opinion 2 in PCTEP2018050562; dated Jan. 10, 2019.
IPRP in PCTEP2017063404; Oct. 10, 2018.
Search Report and Written Opinion in PCTEP2019052151; dated Mar. 29, 2019.
Written Opinion 2 in PCTEP2018075459; dated Aug. 26, 2019.
Search Report and Written Opinion in EP17194986; dated Apr. 19, 2018.
Written Opinion 3 in PCTEP2017063404; dated Aug. 16, 2018.
IPRP2 in PCTEP2017063405; Sep. 20, 2018.
IPRP in PCTEP2017063402; Sep. 24, 2018.
Search Report and Written Opinion in PCTEP2018075459; dated Nov. 27, 2018.
Search Report and Written Opinion in EP17194201; dated Mar. 9, 2018.
Search Report and Written Opinion in PCTEP2017063405; dated Jul. 25, 2017.
Search Report and Written Opinion in PCTEP2018076258; dated Nov. 6, 2018.
Written Opinion 2 in PCTEP2017063404; dated Apr. 18, 2018.
Written Opinion for PCTEP2018075452; dated Sep. 19, 2019.
Search Report in Application No. GB1803058.5; dated Mar. 11, 2019.
Search Report and Written Opinion in PCTPE2019054368; dated Apr. 23, 2019.
Search Report and Written Opinion in PCTEP2019054369; dated Apr. 23, 2019.
Written Opinion in PCTEP2017063405; dated May 17, 2018; World Intellectual Property Org. (WIPO).
IPRP2 in PCTEP2019050562; IPRP2 in PCTEP2019050562; dated May 15, 2019; World Intellectual Property Org. (WIPO).
Search Report and Written Opinion in PCTEP2019052152; dated Mar. 29, 2019.
Search Report and Written Opinion in PCTEP2018050562; dated May 11, 2018; Partial Search Report.
Search Report and Written Opinion in EP17152439; dated Jul. 17, 2017.
Search Report and Written Opinion in EP17152544; dated Jul. 31, 2017.
Search Report and Written Opinion in PCTEP2017063403; dated Aug. 23, 2017.
Search Report and Written Opinion in PCTEP2017063402; dated Sep. 4, 2017.
Search Report and Written Opinion in EP16173806; dated Dec. 19, 2016.
Search Report and Written Opinion in EP16173811; dated Nov. 28, 2016.
Search Report and Written Opinion in EP16173793;dated Dec. 9, 2016.
Search Report & Written Opinion in PCTEP2017063404; dated Aug. 3, 2017.
Search Report and Written Opinion in EP16173798; dated Nov. 24, 2016.
Spruce App; Spruce App; 2019; pp. 1-12 (https://www.thespruce.com/there-is-an-app-for-laundry-2146366).
Clorox My Stain App; Clorox My Stain App; 2020; pp. 1-3 https://play.google.com/store/apps/details?id=net.clorox2.mystain&hl=en_US.
Apps for Dry Clearners; Apps for Dry Cleaners; 2020; pp. 1-2, dlionline.org/apps.
VeryWear App STAIN; VeryWear App STAIN; 2020; pp. 1-4, https://appadvice.com/app/the-stain/510901231.
AEG, My AEG Care App; AEG, My AEG Care App; 2020; pp. 1-10, https://www.aeg.co.uk/about-aeg/connectivity-hub/#732729.
Hoover, Hoover Wizard App; Hoover, Hoover Wizard App; 2020; pp. 1-6, http://www.hooveronetouch.com/gb/index.html.
Candy Smart Touch App; Candy Smart Touch App; 2020 http://www.candysmarttouch.com/eu/index.html.
Samsung, SmartThings Classic App; Samsung, SmartThings Classic App; 2020 https://play.google.com/store/apps/details?id=com.smartthings.android&hl=en.
IPRP2 in PCTEP2019054368; Jun. 23, 2020.

(56) References Cited

OTHER PUBLICATIONS

He Dongping el al., "Design Handbook for Oil Plants", p. 3633, Hubei Science and Technology Press, Aug. 2012.
Wu Jingmiao, "Washing and Stain Removal Techniques for Garments", pp. 2-4, China Goods and Materials Press, Aug. 2007.
Li Yongfan et al., "Basic Courses of Computers in Colleges", p. 69, China Railway Publishing House, Aug. 2011.

* cited by examiner

METHODS AND DEVICES FOR INDIVIDUALIZED LAUNDRY

The present invention relates to methods and devices for individualized laundry, for example, creating or determining a laundry product recipe.

Different fabrics may require various treatments depending on their type. Many user's wardrobes are becoming more complicated comprising a mix of formal wear/fashion items, so-called 'technical' sports fabrics, more rugged garments for e.g. gardening/cleaning, casual wear, soft baby clothes, children's uniforms and robust play clothing etc. On top of this fabric treatment possibilities vary according to usage, wear, cleanliness (soils, stains,) colour levels etc. The situation is further complicated by consumer preferences (sensitivities, preference for biological or otherwise), such that no one laundry product is suitable for all situations.

Use of a single treatment product for all loads coming from the modern wardrobe, regardless of suitability, can mean that unnecessary treatment regimens and/or chemicals such as enzymes, bleaches etc. are used.

In particular, there are cases where the treatment does not require washing, and indeed the optimum treatment would be a non-wash treatment. However, one problem is that many consumers have the habit of gathering all 'laundry' to a laundry receptacle, e.g., a laundry basket. Unfortunately, once a garment has spent any time in the laundry basket, most consumers will prefer to wash before re-wearing. Consumers also have the habit of washing their laundry en masse, so that all items scattered around the house are gathered and assessed together in one event, most commonly near/next to the washing machine, even placed in piles on a kitchen floor adjacent the washing machine according to colour, type etc. Unfortunately, for those garments which would have suited other non-wash treatments, time on the kitchen floor means they now need a more intensive treatment. For those garments which would have enjoyed a lighter refresh wash, time on a kitchen floor may mean the consumer may be inclined to use a harsher wash program. The opportunity to wash with less chemicals or even refresh and re-wear without washing has been lost.

The present invention seeks to address one or more of these problems identified in the prior art.

In a first aspect, the invention provides a computer-implemented method for creating a bespoke laundry treatment recipe comprising the steps:

a. receiving fabric data related to one or more of stain identity, fabric identity, user requirements and user preference;

b. comparing by means of a data processing system said fabric data with ingredient combination data stored on a non-transitory computer readable storage medium; and c. formulating one or more laundry treatment recipes, said recipes being bespoke to the fabric data;

wherein said ingredient combination data comprises:

i. multiple ingredient composition data;

ii. multiple combinations of said ingredient compositions; and iii. multiple treatment (e.g. stain) categories related to said ingredient composition combinations.

In a further aspect, the invention provides a computer-implemented method for creating a bespoke laundry treatment recipe comprising the steps:

a. receiving fabric data related to one or more of stain identity, fabric identity, user requirements and user preference;

b. comparing by means of a data processing system said fabric data with ingredient combination data stored on a non-transitory computer readable storage medium; and c. formulating one or more laundry treatment recipes, said recipes being bespoke to the fabric data;

wherein said ingredient combination data comprises:

i. multiple ingredient composition data;

ii. multiple combinations of said ingredient compositions;

iii. multiple treatment (e.g. stain) categories related to said ingredient composition combinations, and further comprising the step of conflict resolution in terms of treatment and ingredient composition in response to conflicting data.

Optionally, the data may be displayed to the user.

In a further aspect, the invention provides a data processing system comprising means for carrying out the steps of the method of the first aspect and any preferred/optional features.

In a further aspect, the invention provides a computer program comprising instructions which, when the program is executed by a computer, cause the computer to carry out the steps of the method of the first aspect and any preferred/optional features.

In a further aspect, the invention provides a computer-readable medium comprising instructions which, when executed by a computer, cause the computer to carry out the steps of the method of the first aspect and any preferred/optional features.

The computer-readable medium may comprise or have stored thereon said fabric data. The bespoke recipe may also be stored on said computer readable medium.

In a further aspect the invention comprises a multifunction device, comprising:

(i) a user interface which may be a graphical user interface;

(ii) one or data processing systems;

(iii) computer-readable medium; and one or more computer programs, wherein the one or more computer programs are stored in the computer-readable medium and configured to be executed by the one or more data processing systems, and the one or more computer programs including instructions for the method of the first aspect of the invention.

With the arrangement of the invention, the consumer can consider a much wider variety of laundry treatments, building a bespoke recipe from individual ingredients and in any location. The location may be remote from any laundry treatment location and indeed wherever a person may be using, e.g., a smartphone. Importantly, the consumer may build their laundry treatment formulation at a location other than the washing area. This can be more pleasant and convenient but also create new behaviour patterns created allowing more environmentally friendly laundry treatments. For example, the tendency to sort and pile clothes in locations such as a kitchen floor which results in harsher washing for some garments can be halted by providing the consumer remote access to laundry planning and oversight.. The consumer may also assess certain fabrics for laundry needs at the time and location where they stored immediately after wearing, e.g., a blouse worn the previous evening may be hung in a bedroom and the user can indicate the level of wear when removing and hanging. This is often the case for those clothes which have been worn only once or for a short period and which do not require high performance cleaning. The possibility of a lighter, refresh wash or even no washing and, e.g., a refresh and re-wear between washes, is thus encouraged as opposed to the default treatment of full washing. This is advantageous from a financial and environmental standpoint.

A further problem is if fabric data contains conflicts. Many laundry compositions have complicated functionality and complicated inter-relationships of the individual components so conflicts can arise during formulation. Accordingly, the method can further comprise the step of conflict resolution composition in response to conflicting data and/or input as is described herein.

For some consumers, there may be a desire to consider the treatment possibilities away from home, whilst travelling with only, for example, a smartphone. In such cases, a treatment recipe could be designed through a smartphone or other travel-friendly device or system, e.g., tablet, electronic assistant, smart watch, remote login computer program.

Further, some consumers use a laundry service, but also wish to retain precise control over the laundry products used. With the individualized laundry methods and devices, the consumer can build a bespoke recipe and this can be communicated to and/or created for the laundry service used.

Accordingly, the method of the invention may comprise the step of communicating said recipe and/or said user input to a remote computer using any suitable wireless or non-wireless communication technology (e.g., Bluetooth, Wi-Fi, cellular).

As used in the description and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The fabric data is preferably displayed using a display. As used herein "display" includes any means for displaying data e.g. the fabric data and/or also input data, said data which may include graphical images either in visual form to present an image visible to the human eye, and/or in tactile form (for visually impaired users). Preferably the display is an electronic display and more preferably it is a digital display. Examples include screens, segment displays: full area two-dimensional or video displays, e.g., computer display monitors, television sets. Any display technology may be used such as light emitting diode display (LED), electronic paper display (EPD), Liquid crystal display (LCD), including multiplexed displays.

User Interface

The display may comprise a user interface (UI), for example, the UI may be presented to the user as part of the display, e.g., on a digital display screen. The display may comprise various interaction mechanisms including: manipulation of buttons, one or more touch-sensitive surfaces of the display screen itself (e.g., touch screen displays and/or touch pads), or other touch devices (track pads, rolling wheels/balls), voice commands, gestures or other suitable methods.

The user data may be input via a user interface (UI). The UI may be part of the display as described above or at least part of the UI may include other and/or additional devices such as keyboard, mouse, etc. The UI may comprise a graphical user interface (GUI) or it may be a text-based UI.

Data may be input by a user via various user interaction mechanisms, including: manipulation of buttons, touch-sensitive surface of the display itself (e.g., touch screen displays and/or touch pads), or other touch devices (track pads), voice commands, gestures or other suitable methods.

The UI may be interactive and, for example, comprise an interactive digital assistant. Interactive digital assistants can provide a beneficial interface between human users and electronic devices. Such assistants can allow users to interact with devices or systems using natural language in spoken and/or text forms. For example, a user can provide a speech input containing a user request to a digital assistant operating on an electronic device. The digital assistant can interpret the user's intent from the speech input and operationalize the user's intent into tasks. The tasks can then be performed by executing one or more services of the electronic device, and a relevant output responsive to the user request can be returned to the user.

Digital Assistant

There may be a dedicated user interface for interacting with the interactive digital assistant. For example, an electronic device can implement a dedicated voice interface for interacting with the digital assistant. Alternatively or additionally, there may be a GUI comprising a plurality of messages between the user and the digital assistant which can be shown on a display. Messages can be presented in a conversational view, one at a time, or any other suitable manner. User input can be received and in response to receiving the user input, the user input can be displayed as a first message in the GUI. The method may involve the step of causing an action to be performed in accordance with a user intent derived from the user input. A response based on the action may be displayed as a second message in the GUI.

The method may include the step of communicating with a remote user device such as a mobile phone, tablet or laptop, washing machine, (via, e.g., Wi-Fi, Bluetooth, cellular) to receive data and/or user inputs from said remote user device. Accordingly, the UI and any associated computing devices of the invention may be operable to communicate with said remote user device.

Accordingly, in a further aspect, the invention provides a computer-implemented method for creating a bespoke laundry treatment recipe comprising the steps:

a. receiving fabric data related to one or more of stain identity, fabric identity, user requirements and user preference;

b. comparing by means of a data processing system said fabric data with ingredient combination data stored on a non-transitory computer readable storage medium; and c. formulating one or more laundry treatment recipes, said recipes being bespoke to the fabric data;

wherein said ingredient combination data comprises:

i. multiple ingredient composition data;

ii. multiple combinations of said ingredient compositions;

iii. multiple treatment (e.g. stain) categories related to said ingredient composition combinations, and wherein the method utilized a user interface whereby a user can provide input by speech commands.

Computer-Readable (Storage) Medium

The non-transitory computer-readable medium may comprise or have stored thereon said fabric data. At least some of the fabric data may also be stored remotely, e.g., on a remote server. Thus, the recipe may be obtained from an internal memory within a local device (i.e., local to the user, e.g., user's smartphone, computer or washing machine) or may be obtained from an external/remote memory accessed, for example, via the internet (via e.g. Wi-Fi, Bluetooth, cellular).

The claimed invention is not limited by the form of the computer-readable media on which the computer-readable instructions and/or databases of the inventive process are stored. For example, the instructions and databases can be stored on CDs, DVDs, in FLASH memory, RAM, ROM, PROM, EPROM, EEPROM, hard disk or any other information storage device with which the processor and computer program can communicate. The program be stored on a same memory device or on different memory devices.

Computer Programme

The computer programme may be stored and accessed locally (i.e. local to the user e.g. user's smartphone or computer) or may be obtained from an external/remote memory stored in the 'cloud' and accessed, for example, via an internet connection (via e.g. Wi-Fi, Bluetooth, cellular) or direct electronic link.

Multi-Function Device

The "multi-function device" of the invention may include any electronic device such as a smartphone or computer, electronic note pad, etc., which comprise functionality beyond that of the present invention, e.g., including camera, photography, telephone, diary, messaging, etc. functions.

Computing Devices

Suitable computing devices for employment of the invention may include any suitable computing device, e.g., desktop computer, and may include portable communications devices or other home computing systems such as those that run home climate, entertainment or security systems. Said portable communications devices may comprise a portable multifunction device such as a mobile telephone that also contains other functions, such as personal data/digital assistant (PDA) and/or music player functions, or a laptop, tablet or notebook with communication functions. Exemplary embodiments of portable multifunction devices include, without limitation, the iPhone® and iPod Touch®, iPad® devices from Apple Inc. of Cupertino, Calif.; Galaxy® by Samsung; Microsoft Surface® and mobile devices, and other portable devices, such as laptops or tablet computers. Alternatively, the device is not a portable communications device, but is a e.g. a 'desktop' or other in-home computer systems with a UI which may be a touch-sensitive surface (e.g., a touch screen display and/or a touch pad) or other input means such as keyboard, trackpad, mouse, etc. Many users now have 'desktop' devices in rooms upstairs, e.g. spare bedrooms or even the user's bedroom. Such devices offer an ideal opportunity to review the laundry needs of items removed e.g. before showering or changing garments.

The data processing system can include one or more processing devices ("processors") and memory connected to and/or part of the computing devices and configured to perform the functions specified, namely, receiving fabric data, accessing stored ingredient combination data, comparing the fabric data with said ingredient combination data, formulating one or more laundry treatment recipes by determining correct components, combinations, dosage, etc. based on the comparison of ingredient combination data and fabric data. This can also be done using a number of intermediate steps, such as, accessing possible data, sending at least some data for display, receiving a choice of one or more of the data displayed to the user, etc.

The portable device may comprise a wearable electronic device. This allows for laundry planning and/or building a bespoke recipe from individual ingredients in any location in a convenient manner.

Wearable electronic devices are preferably multi-functional e.g. may also record health and/or nutrition data of a user. An example is an athletic performance monitoring device such as a watch having enhanced athletic functionality. Using such a device would allow for stains and/or usage to be recorded in situ. In one example, the user may be enjoying outdoor sports and their sports garments become stained with, e.g., bicycle chain oil. The user can record this data using the computer program running on their sports watch.

When they return home, their sports clothes can be stored and forgotten until 'laundry day' knowing the stain information and dedicated laundry treatment is stored ready for when it is needed.

Connection to Dispensing Device

The computer programme and/or computer readable medium and/or UI may be connected or integral with a controllable dispensing device for supplying a dose of laundry treatment product, the device having multiple reservoirs containing compositions corresponding to said multiple ingredient compositions such that each reservoir comprises an individual ingredient composition. The dispensing device may be configured to dispense from one or more reservoirs under control of the program, to provide said laundry product according to a bespoke recipe created.

The computer programme and/or computer readable medium may be connected to or integral with a washing machine, e.g., part of a control system for an automatic washing machine.

The UI may be incorporated into a washing machine such that the method of the invention is part of a washing machine program selection. Connections can be through any suitable manner, wireless or wired.

Accordingly, in some cases the computer programme may determine how much product is dosed from internal or external product reservoirs connected to the washing machine, based on the user input.

Fabric Data (i) Stain Identity

The stain identity data may be displayed in the form of one or more lists of individual stains. The user may be prompted to select one or more stains from said list(s). Alternatively, the user may be prompted to de-select one or stains (i.e. those not present on the article to be laundered) from said list/s.

Recently selected stains may be displayed (for example, the last five or ten from previous uses) or most frequently selected over the device's history.

To assist the user, displayed data may be filtered, for example to group stains by, for example, a 'Food and Drink' category and/or stain colour. The user may be prompted to de-select one or stains (i.e. those not present on the article to be laundered) from said 'type' list/s. For example, an 'Outdoor' category may list mud and grass which the consumer then deselects stains not present on the article to be laundered.

Each category may then be divided into subcategories, such as "Fruit and Vegetables", "Oils and Fats" and/or even individual stains, etc. In other words, the stain selection may be presented as multiple filterable lists, e.g. a second filterable list within a first filterable list.

Stain identity be displayed by indirect criteria which infers a particular stain/stain type e.g. user type, user behaviour, user location, location environment, weather and any combination thereof. Thus, stain identity may be based on one or more of the following categories:

1. User Activity and/or location of activity, e.g., Sport/Gym indoor (sweat stains), Sport outdoor (sweat stains, mud stain, grass stain);
2. Weather, e.g., high humidity implies certain garment will carry more sweat stains, wet weather implies mud stains, sun may imply sun-screen stains;
3. Dining, e.g., inferring food/drink stains;
4. Garment user, e.g. kids as a user implies more play and outdoor activities (mud and grass stains), baby as user implies more body stains;
5. Garment type, e.g., Bedding (body stains);
6. User Location, e.g., certain geographical locations may indicate presence of certain minerals in mud stains depending on location, location may indicate ionic/pH strength of wash water affecting stain treatment (needs such as sequestrant).

Advantageously, user location may be obtained from GPS data, electronic calendars or other user data sources which may be stored on the computer readable medium or obtained, for example, by remote connection (Bluetooth, Wi-Fi, cellular).

Certain individual stain data may remain hidden and not displayed. This feature may be activated according to consumer preference for less or more detail in data. Accordingly, the user may need to select only certain categories, e.g., activity, weather and the stain selection calculated from that data. Alternatively, the data may be presented as multiple filterable lists, e.g., a second filterable list (e.g. of individual stains) within a first filterable list (of e.g. categories). The recipe can be designed from one or more of the filterable lists, so a user may input selections from a first list and then decide to speed up the process and so the recipe may be formulated from the first list without further selections from second or further lists.

(ii) Fabric Identity

Criteria may include fabric colour and/or categories, e.g., whites, lights, coloureds or mixed. As a result, the recipe may be formulated accordingly, for example, to include a bleach/whitening ingredient composition (for whites) or that minimal or no bleach ingredient composition should be added in the case of a coloured wash.

Alternatively, or additionally, the criteria may be fabric type, e.g. the type of fibres such as cotton, polycotton, polyester.

Fabric type criteria may further include and/or be based on fabric usage data such as whether the fabric is used for underwear, sportswear, technical fabrics/garments with special surface finishes/properties, etc.

Fabric type may be derived from data regarding user behaviour, user location, location environment, weather and any combination thereof. Such data can be obtained through user input or other means. Treatment options (and from that bespoke recipes) may be derived from fabric type by first establishing fabric usage. These options may comprise stain treatment, and additionally or alternatively other treatments. The fabric identity data may comprise one or more of the following categories:

1. User behaviour, e.g., Sport/Gym (infers bright colour or whites, breathable fabrics and swim-wear which require milder detergents)
2. Use environment or weather, e.g., rain (infers waterproof/showerproof fabrics which may require milder detergents and waterproofing)
3. Usage, e.g., used as bedding or towels (infer cotton and polyester, infers particular perfume needs)
4. Garment user, e.g., baby (infers soft fabrics or cotton fabrics)
5. Garment type, e.g., Bedding (inferring sweat and requiring malodour/perfume treatment needs), or Sports/Technical (requiring mild detergent and, e.g., waterproofing, anti-malodour)
6. Work uniforms, e.g, work shirts (imply cotton, polyester and creasing, require wrinkle release)

Fabric identity data may be directly based on user profile criteria (since the user experience will affect fabric) without establishing fabric type. The user profile criteria may be derived directly from data regarding user behaviour, user location/environment, weather and any combination thereof. Thus, the displayed fabric data may be based on one or more of the following user profile categories:

1. User Activity, e.g., Sport/Gym (infers anti-maldour treatment), outdoor dining (infers perfume/anti-malodour treatment to deal with smoke smells, nicotine smells);
2. User environment such as weather, e.g., rain (infers waterproofing); humid office (infers anti-malodour, fresh perfume treatment);
3. User age, e.g., baby (no/less perfume, mild detergent).

Fabric identity data may also be read from readable tags on garments, e.g., RFID, barcode, or QR codes, which might give colour type, dye type, finish type, fibre types present etc.

Multiple user profiles may be input and stored. With this feature the user can build a user profile such that recipes can be personally tailored. User profile location data may be obtained from GPS data, electronic calendars or other user data sources which may be stored on the computer readable medium or obtained by remote connection (Bluetooth, Wi-Fi, cellular, near field communication, radio frequency, infrared).

The derived fabric identity data and any inferred treatment may also be displayed as a suggestion for selection by the user. The fabric identity data may be displayed in the form of one or more lists of individual fabric identities. The user may be prompted to select one or more fabric identities from said list(s).

Specific fabric identities may be displayed for easier or quicker selection (for example, the last five or ten recently selected fabric identities from previous uses) and/or fabric identities most frequently selected over the device's history or known common fabric identities from user input or collected data.

(iii) User Requirements

Optionally, a user may input certain requirements. These must be accommodated by the device in determining the laundry recipe. An example of a user requirement is to exclude ingredients, for example, because a family member has an intolerance (for example, suffers skin irritation from certain products or ingredients). User requirements may be treated as hard constraints which are not overridden.

(iv) User Preferences

Optionally, a user may input certain preferences. These may be accommodated by the device in determining the laundry recipe, and can be balanced against cleaning performance and other selections. For example, a user may select "not perfumed" or "perfumed" with a specific type of perfume. User preferences may be treated as soft constraints which may be overridden (such that these are balanced against cleaning performance and/or other selections/requirements).

Said input data can be based on at least two criteria selected from (i) to (iv), i.e., from:

(I) stain identity;

(ii) fabric identity;

(iii) user requirements; and (iv) user preferences.

Said input data can be based on at least two criteria selected from (i) stain identity and (ii) fabric identity.

Fabric identity data may be input directly or derived from other input data as described above, e.g., user type, user behaviour, user location, location environment, weather and any combination thereof.

Said input data can be at least in part indirectly derived from other input data e.g., user type, user behaviour, user location, location environment, weather and any combination thereof. Said input data may be at least in part indirectly derived from user profile data.

Where categories of data, e.g. fabric type or user activity, are displayed, multiple categories may be selected. This may allow more precise tuning of the recipe. Multiple category selection can be interdependent such that the selection of one narrows the next category selection, e.g., the selection of bedding prevents the addition of waterproofing, and the selection of Humid and Outdoor Sport may trigger an increase in sweat-stain treatment options.

Whilst consumers may be familiar with conventional treatment products, most are not familiar with the individual components or technologies. Almost all consumers have very little understanding of the complicated functionality and inter-relationships of the individual components of laundry products. Many consumers also have no desire to spend time learning about this. Thus, the problem arises in providing the consumer with greater control over ingredient formulation for bespoke laundry treatment whilst acknowledging a lack of knowledge and interest in the chemistry required to formulate such products. A further problem is that consumers can become frustrated if their conflicting instructions (user input) are overridden (to enable a workable formulation) and they do not understand why. For example, in the UK, detergents are sold as biological (with enzymes) or non-biological (without) however many users are unaware that understand that selecting "non-biological" will translate to a formulation with no stain-treating enzymes. Therefore, if the user selects both non-biological and grass/blood stains, and the stain selection is overridden to prioritise the non-biological selection, the consumer may then be disappointed by a lack of stain treatment performance—especially after they specifically told the machine of the exact stain.

Accordingly, the method can further comprise the step of conflict resolution composition in response to conflicting data and/or input. The method preferable involves the step of determining an overriding priority in terms of treatment and ingredient composition in response to conflicting data and/or input.

Thus, if in the above example, the overriding priority is stain treatment, then a biological (enzyme-containing) detergent may be added (and the user warned).

For such conflict resolution, the method can comprise the steps of:

a. displaying conflicting input data;

b. determining the overriding treatment/ingredient priority based on selected fabric data in step a; and c. formulating one or more bespoke laundry recipes according to said overriding priority.

The conflicting fabric data can include combinations of the fabric data selected by the user. The conflicting data combinations can also be displayed such that the user can understand the conflict and possibly set the priority for the conflict. Further, the conflicting data may be based on any one or more of stain identity, fabric identity, user requirements and user preferences, e.g., exclusion of ingredients such as enzymes (e.g. by selecting "non-biological").

The method may comprise the step of comparing said conflicting input data with ingredient combination data stored on non-transitory computer readable storage medium, and thereby formulating one or more laundry treatment recipes, said recipes being bespoke to the conflict input data and said overriding priority.

The method may comprise the step of comparing input data with ingredient conflict data, this data comprising conflicting combinations of ingredients where wash performance, safety, or other performance factors would be compromised by such combinations.

For example, if the user selects "non-biological" and certain enzyme-treatable stains, e.g., grass/blood, the conflict message may advise the user to select a priority for either stain treatment or "non-biological". Optionally, the method may comprise the step of displaying information on the selections, such as a link to website for further information regarding, in this case "non-biological" and enzymes.

Thus, the method can solve the problem of providing the consumer with greater control over ingredient choice, amount, ratio etc., whilst reducing any negative impact of conflicting choices based on a lack of formulation chemistry knowledge.

Other conflicts may arise where the consumer selects a first input and then a conflicting combination second selection (so where selection 1 conflicts with selection 2):

| Selection 1 | | Selection 2 | |
|---|---|---|---|
| Data criteria | selection | Data criteria | selection |
| Fabric type/colour | Mixed, Coloured | Composition | Bleach (should not use bleach) |
| Fabric type/colour | Technical (to be waterproofed) | Composition | Detergent (should be pure soap) |
| Fabric Stain | Grass | Composition | Non-biological |

For each conflict, the user interface may prompt the user that there is a conflict and offer a further selection to resolve the conflict.

A further problem is that the level of detail of the user input is often commensurate with the level of performance expected by the consumer. A further technical problem is that the level of detail of the user input is often critical to user engagement and results achieved.

Accordingly, the method may comprise different operating modes to suit different users, each mode having a different level of input data detail required, e.g., 'Totally Bespoke' (high level of detail), 'Do it all for me' (low level of detail). Advantageously, the method may include the step of selecting a mode of operation. This can determine what fabric data may be needed and/or displayed. The fabric data may be partially or wholly displayed depending on the mode selected, system and user preferences. Categories of fabric data may be displayed instead of specific fabric data (such as individual stains). The step may be at the beginning of the method or it may be prompted by predetermined user input data, e.g., based on the specification of certain key preferences. So, a user may indicate a preference for stain-treatment performance over other treatment options, in which case they may be alerted to select 'Totally Bespoke' so that they can specify individual stains, etc.

A search function may be incorporated such that the user is prompted to enter data in the form of a query. This may be, for example, "I want to clean . . . ?" or "I need to remove grass stains". The input data may then be compared against said ingredient combination data to derive a bespoke recipe or recipes. The ingredient combination data comprises (i) multiple ingredient composition data (e.g., what components or compositions are available); (ii) multiple combinations of said ingredient compositions; and (iii) multiple treatment (e.g., stain) categories related to said ingredient composition(s) and/or combinations and the input data in the form of a query may be compared against any or all of these data groups (e.g., through referencing one or more databases).

Said multiple ingredient composition data comprises multiple compositions of laundry treatment ingredients formed of one or more components or compositions available for the recipe. The method combines one or more of these ingredients based on user input to design a bespoke laundry treatment recipe.

Multiple combination data relates to the combinations of the separate components or compositions, including but not limited to what components can be combined, pre-calculated combinations of separate components, wash or combination parameters related to combining components (e.g., run-time for combination of specific components), different combinations of the ingredient compositions, and ingredient composition ratios (which may be by volume, weight etc.). The multiple combinations of the components, compositions and/or ingredients represent the bespoke recipes. These may be predetermined combinations already stored in memory, determined combinations and/or user defined.

Multiple treatment (e.g. stain, perfume, anti-malodour, etc.) categories are related to said ingredient composition combinations. For example, the treatment category could be input (e.g., grass stain treatment), and the method could determine an ingredient component or compositions that would be suitable for treating such a category.

The ingredient compositions may comprise any one or more of the following non-exclusive list by way of example only. Preferably each ingredient composition is mutually exclusive of other ingredients, so, e.g., the detergent base preferably excludes perfume and enzyme and bleach and vice versa.

- detergent base;
- enzyme;
- bleach;
- pH adjusters;
- fabric rinse conditioner;
- fabric care composition;
- perfume booster;
- pre-treatment/direct application composition which may optionally be for use in sprayers, scrubbing devices, etc.;
- wash-in technical treatments, e.g., waterproofing, anti-bacterial, stain-proofing;
- refresh and re-wear compositions which may optionally be for use in sprayers comprising any one or more of: perfume, anti-malodour component/s and anti-wrinkle components, e.g., silicone;
- chelating materials;
- water conditioning agents to achieve the aims of building, increasing the ionic strength or adjusting the native pH range of the source water and hence wash solution (can provide example materials);
- laundry serums comprising with perfume, care benefit agents, etc.;
- dye catchers, dye transfer inhibitors The multiple ingredient compositions can comprise combinations of one or more of the following:

(I) an ingredient composition comprising a surfactant;

(ii) ingredient composition(s) comprising at least one enzyme;

(iii) an ingredient composition comprising a bleach component;

(iv) an ingredient composition comprising an alkaline component;

(v) a perfume ingredient composition;

(vi) a care and/or refresh ingredient composition.

The following are representative ingredient compositions which may be used to create recipes based on user input as described herein. It will be appreciated that it is not essential that all of the following compositions are present in the device. Further compositions may also be present.

(i) Ingredient Composition Comprising a Surfactant

Also referred to as a detergent formulation/composition, this composition comprises one or more surfactants. Preferably, the composition does not contain an enzyme. Preferably, the composition does not contain a bleach. Optionally, the composition does not contain a sequestrant.

Example components for the detergent composition include the following:

Anionic surfactants, for example having an anion selected from linear alkyl benzene sulfonate (LAS), primary alkyl sulfate (PAS), alkyl ether sulfate (AES) and mixtures thereof.

Nonionic surfactants, for example which may include primary and secondary alcohol ethoxylates, especially $C_8$-$C_{20}$ aliphatic alcohol ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl polyglycosides, glycerol monoethers and polyhydroxy amides (glucamide). Mixtures of nonionic surfactant may be used.

Amine Oxide Surfactants of formula $R^1N(O)(CH_2R^2)_2$ in which $R^1$ is a long chain moiety and each $CH_2R^2$ is a short chain moiety. $R^2$ is preferably selected from hydrogen, methyl and —$CH_2OH$. In general $R^1$ is a primary or branched hydrocarbyl moiety which can be saturated or unsaturated, preferably, $R^1$ is a primary alkyl moiety having chain length of from about 8 to about 18 and $R^2$ is H. These amine oxides are illustrated by $C_{12-14}$ alkyldimethyl amine oxide, hexadecyl dimethylamine oxide, octadecylamine oxide.

Some zwitterionic surfactant, such as sulphobetaine, may be present. A preferred zwitterionic material is a betaine available from Huntsman under the name Empigen® BB.

Preferably the compositions contain less than 10 wt %, more preferably less than 5 wt % zwitterionic surfactant.

Cationic Surfactants may be included, but are preferably substantially absent from the detergent formulation.

A particularly preferred surfactant system is provided by linear alkyl benzene sulfonate (LAS) and $C_{10}$-$C_{15}$ alcohol ethoxylated nonionic surfactant with 2 to 7 EO.

(ii) Ingredient Compositions Comprising at Least One Enzyme

While enzymes are powerful stain removers, for many wash loads some or all enzymes may be omitted. For example, different families of enzymes are effective against different classes of stain, and a large number of laundry loads are not stained at all. Including enzymes in each and every wash may therefore be wasteful.

The inventors have observed that certain enzymes cannot be stored in combination. For example, protease and lipase cannot usually be combined in a single liquid composition because as the protease may digest the lipase on storage. Similarly, protease may digest cellulase on storage in a liquid. However, lipase gives excellent benefits on removal of fats, while cellulase gives improved fabric treatment with colour preservation and pill removal and/or background whiteness benefit (depending on the cellulase used). This means that conventional laundry projects often contain an enzyme mix.

The present invention permits, through use of more than one ingredient composition comprising enzymes, the assorted benefits of these enzymes to be accessed in a single load.

For example, a first 'enzyme' ingredient composition may comprise a protease and a second 'enzyme' ingredient composition comprises a cellulase and/or a lipase and/or an amylase and/or a mannanase. The method may select neither, one or both of these depending on, for example, the type of staining.

Suitably, the compositions are mutually exclusive so that the first enzyme ingredient composition does not include any enzymes of the second and vice versa. The first enzyme ingredient composition may optionally further comprise a pectate lyase.

The first enzyme ingredient composition may optionally further comprise a surfactant, for example, sodium laureth sulfate (SLES). This additional surfactant may be used to boost detergency over and about that of the detergent composition, which may be useful in the case of stained loads. Certain surfactants are also known to be more suited to enzymatic cleaning processes.

The second 'enzyme' ingredient composition may be indicated for stains such as gravy, starch-based stains, chocolate and chocolate products, fatty cooking stains.

(iii) And (iv) Ingredient Compositions Comprising a Bleach Component and an Alkaline Component compositions of this type may be used in combination. In other words, the compositions may be combined together, the alkali's role being to activate the bleach ready for, or during, a wash or a rinse process in order to provide an effective bleaching action.

These may be displayed for stain removal e.g. tea, coffee, wine, and berry stains, as well as improving overall whiteness and providing hygiene benefits.

(v) Ingredient Composition Comprising a Bleach Component

Suitably, the composition comprising a bleach component has a pH of 7 or less, while the composition comprising an alkali (v) is suitable for raising the pH wash liquor in order to initiate and/or promote action of the bleach component said wash liquor.

Preferably the composition containing the bleach component has a pH of 6 or less, and more preferably has a pH in a range of 3 to 5. If the composition is not aqueous based it may have a pH as described when measured on dilution of the liquid composition to 1% using demineralised water.

The composition comprising a bleach component may additionally contain detergent active components (e.g. surfactants) which are compatible with the bleach component, such as discussed below. The composition containing an alkali component (v) may also contain detergent active components.

The bleach component is a component suitable for use in a laundry process. Preferably the bleach component comprises an oxygen bleach system. Such bleach systems may be, for example, a peroxygen bleach or a peroxy-based or peroxy-generating system.

Mixtures of bleaches can also be used.

Preferably the bleach component is selected so as to be easy to handle and storable according to the requirements for the least hazardous class of organic peroxides. This allows the first composition to be safely transported to and stored in a domestic setting.

A preferred category of bleaches encompasses percarboxylic acid bleaching agents, salts thereof and precursors thereof, especially organic percarboxylic acids, salts thereof and precursors thereof, particularly aromatic percarboxylic acids and especially heteroaromatic peroxycarboxylic acids, salts and precursors thereof.

Particularly preferred embodiments employ 6-(phthalimido) peroxyhexanoic acid (PAP) and salts thereof. The peracid formula is shown below.

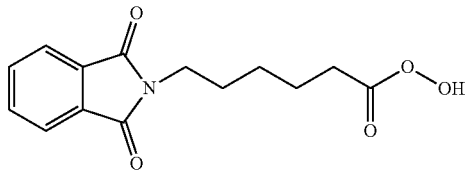

Peroxygen bleaches, perborates and percarbonate bleach components may optionally be combined with bleach activators which lead to the in situ production during the washing process of a peroxy acid corresponding to the bleach activator. If such a bleach component is in liquid composition, then a bleach activator will generally be provided in a different composition to the bleach component.

Examples of preferred peroxy acid bleach precursors or activators are TAED (N, N, N' N'-tetraacetyl ethylene diamine) and SNOBS (sodium nonanoyloxybenzene sulphonate).

Typically the composition may comprise up to 20 wt % of bleach component, especially up to 19 wt % and more preferably up to 18 wt %. Suitably the composition may comprise at least 2 wt % of bleach component, preferably at least 3 wt %, more preferably at least 4 wt % and especially at least 5 wt %.

In preferred embodiments, the composition contains additional fluorescent and/or whitener components such as shading dyes. Such additional components may be present preferably in amounts of from 0.005 wt % up to 5 wt %, especially up to 2 wt % and more preferably up to 1 wt %.

Fluorescent agents may be supplied and used in the form of their alkali metal salts. The total amount of the fluorescent agent or agents used in the composition is generally from 0.005 to 5 wt %, preferably from 0.005 to 2 wt %, more preferably 0.01 to 0.5 wt %.

Preferred classes of fluorescent agent are: Di-styryl biphenyl compounds, e.g. Tinopal (Trade Mark) CBS-X and Tinopal CBS-CL, Di-amine stilbene di-sulphonic acid compounds, e.g. Tinopal DMS pure Xtra, Tinopal SBMGX, and Blankophor (Trade Mark) HRH, and Pyrazoline compounds, e.g. Blankophor SN.

Preferred fluorescent agents are: salts of: 2 (4-styryl-3-sulfophenyl)-2H-napthol[1,2-d]triazole,; 4,4'-bis{[(4-anilino-6-(N methyl-N-2 hydroxyethyl) amino 1,3,5-triazin-2-yl)]amino}stilbene-2-2' disulfonate; 4,4'-bis{[(4-anilino-6-morpholino-1,3,5-triazin-2-yl)]amino} stilbene-2-2'-disulfonate; and 4,4'-bis(2-sulfostyryl)biphenyl.

Shading dyes may optionally be included. These may enhance the perception of whiteness. They may, for example, be violet or blue.

The composition may optionally further comprise a surfactant, for example SLES. Once again, this may boost detergency over and above composition (i) alone in the presence of stains.

(vi) Ingredient Composition Comprising an Alkaline Component pH adjustment may be effected with alkalinity sources such as, but not limited to: alkanolamines, such as monoethanolamine MEA, diethanolamine, and triethanolamine TEA, and preferably MEA; alkali metal hydroxides, such as NaOH and KOH; alkali metal carbonates and bicarbonates such as sodium carbonate/bicarbonate and alkali metal silicates such as sodium silicate. Accordingly, the alkaline component may be one or more of these compounds.

The alkaline composition may be up to 60 wt % in total of alkalinity components, more preferably up to 50 wt %, especially up to 40 wt %, even more preferably up to 30 wt %. For example, it may contain at least 15 wt % and preferably at least 20 wt %.

Optionally the composition has a pH of at least 8, preferably at least 9, more preferably at least 10, especially at least 11, and most preferably at least 12. If the composition is not aqueous based it may have a pH in those ranges when measured on dilution of the liquid composition to 1% using demineralised water.

Preferably a dose of laundry product obtained from the combination of the bleach and pH compositions, when diluted with 15 litres of water in a washing machine, would be effective to provide a wash liquor having a pH of at least 6, preferably in a range of 7 to 11, more preferably in a range of 8 to 10, most preferably in a range of 8 to 9.5, and especially 8 to 9. Of course, different washing machine use different amount of water and dilution with greater amounts, for example 60 litres, is envisaged.

Preferably the composition contains components which function to buffer a wash liquor within a pH range of 7 to 11, more preferably 8 to 10 or to 9.5, especially 8 to 9.

The alkaline composition may include a builder. Suitable builders include inorganic materials (such as sodium citrate, sodium carbonate and sodium bicarbonate) and organic materials (such as polyacrylic acid, polymaleic acid and polyacrylic/polymaleic acid copolymers and salts thereof). The builder component(s) may be present in a total amount of from 5 wt % up to 50 wt % of the composition (v), more preferably up to 40 wt %, more preferably up to 30 wt %, especially up to 25 wt % and most preferably up to 20 wt %. The synergistic effects from a raised pH and lowered in-wash pCa or building enhance the detergency of both particulate and oily stains.

The alkaline composition may optionally further comprise a surfactant, for example SLES. Once again, this may boost detergency over and above composition (i) alone in the presence of stains.

(vii) Ingredient Composition Comprising a Sequestrant;

The inventors have determined that the inclusion of a sequestrant increases the flexibility of the device to deal with a variety of stains and garment types economically. Separating sequestrant from the detergent composition may also permit greater flexibility of detergent formulation.

The sequestrant composition may, for example, be dispensed to aid removal of bleachable stains on coloured garments, where use of a bleach may risk damage to the dye or fabric.

Suitably therefore, the sequestrant composition does not include a bleach.

Example sequestrants are HEDP (1-Hydroxyethylidene-1,1,-diphosphonic acid), for example sold as Dequest 2010, and (Diethylenetriamine penta(methylene phosphonic acid or Heptasodium DTPMP), Dequest® 2066. Preferably the composition contains up to 40% w/w of a suitable sequestrant system, including mixtures of different commercial sequestrants.

(vii) Anti-Malodour Treatment

The anti-malodour composition may contain any suitable anti-malodour component.

Preferred examples of the anti-malodour compositions may contain anti-malodour components in an amount of 1 to 90 wt %, (of the anti-malodour composition)

Any suitable anti-malodour component may be used or any combination of the agents below. Indeed, an anti-malodour effect may be achieved by any compound or product that is effective to "trap", "absorb" or "destroy" odour molecules to thereby separate or remove odour from the garment.

The anti-malodour component may be selected from the group consisting of: uncomplexed cyclodextrin; odour blockers; reactive aldehydes; flavanoids; zeolites; activated carbon; and mixtures thereof.

Preferably the uncomplexed cyclodextrin is water soluble. As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof.

So called "Odour blockers" can be used as an anti-malodour component to mitigate the effects of malodours. Non-limiting examples of odour blockers include 4-cyclohexyl-4-methyl-2-pentanone, 4-ethylcyclohexyl methyl ketone, 4-isopropylcyclohexyl methyl ketone, cyclohexyl methyl ketone, 3-methylcyclohexyl methyl ketone, 4-tert.-butylcyclohexyl methyl ketone, 2-methyl-4-tert.butylcyclohexyl methyl ketone, 2-methyl-5-isopropylcyclohexyl methyl ketone, 4-methylcyclohexyl isopropyl ketone, 4-methylcyclohexyl secbutyl ketone, 4-methylcyclohexyl isobutyl ketone, 2,4-dimethylcyclohexyl methyl ketone, 2,3-dimethylcyclohexyl methyl ketone, 2,2-dimethylcyclohexyl methyl ketone, 3,3-dimethylcyclohexyl methyl ketone, 4,4-dimethylcyclohexyl methyl ketone, 3,3,5-trimethylcyclohexyl methyl ketone, 2,2,6-trimethylcyclohexyl methyl ketone, 1-cyclohexyl-1-ethyl formate, 1-cyclohexyl-1-ethyl acetate, 1-cyclohexyl-1-ethyl propionate, 1-cyclohexyl-1-ethyl isobutyrate, 1-cyclohexyl-1-ethyl n-butyrate, 1-cyclohexyl-1-propyl acetate, 1-cyclohexyl-1-propyl n-butyrate, 1-cyclohexyl-2-methyl-1-propyl acetate, 2-cyclohexyl-2-propyl acetate, 2-cyclohexyl-2-propyl propionate, 2-cyclohexyl-2-propyl isobutyrate, 2-cyclohexyl-2-propyl nbutyrate, 5,5-dimethyl-1,3-cyclohexanedione (dimedone), 2,2-dimethyl-1,3-dioxane-4,6-dione (Meldrum's acid), spiro-[4.5]-6,10-dioxa-7,9-dioxodecane, spiro-[5.5]-1,5-dioxa-2,4-dioxoundecane, 2,2-hydroxymethyl-1,3-dioxane-4,6-dione and 1,3-cyclohexadione.

Odour blockers are disclosed in more detail in U.S. Pat. Nos. 4,009,253; 4,187,251; 4,719,105; 5,441,727; and 5,861,371, incorporated herein by reference.

Reactive aldehydes can be used as anti-malodour component to mitigate the effects of malodours. Examples of suitable reactive aldehydes include Class I aldehydes and Class II aldehydes. Examples of Class I aldehydes include anisic aldehyde, o-allyl-vanillin, benzaldehyde, cuminic aldehyde, ethylaubepin, ethyl-vanillin, heliotropin, tolyl aldehyde, and vanillin. Examples of Class II aldehydes include 3-(4'-tert.butylphenyl)propanal, 2-methyl-3-(4'-tert-butylphenyl)propanal, 2-methyl-3-(4'-isopropylphenyl)propanal, 2,2-dimethyl-3-(4-ethylphenyl)propanal, cinnamic aldehyde, a-amyl-cinnamic aldehyde, and a-hexyl-cinnamic aldehyde. These reactive aldehydes are described in more detail in U.S. Pat. No. 5,676,163. Reactive aldehydes, when used, can include a combination of at least two aldehydes, with one aldehyde being selected from acyclic aliphatic aldehydes, non-terpenic aliphatic aldehydes, non-terpenic alicyclic aldehydes, terpenic aldehydes, aliphatic aldehydes substituted by an aromatic group and bifunctional aldehydes; and the second aldehyde being selected from aldehydes possessing an unsaturation alpha to the aldehyde function conjugated with an aromatic ring, and aldehydes in which the aldehyde group is on an aromatic ring. This combination of at least two aldehydes is described in more detail in WO 00/49120. As used herein, the term "reactive aldehydes" further encompasses deodourizing materials that are the reaction products of (i) an aldehyde with an alcohol, (ii) a ketone with an alcohol, or (iii) an aldehyde with the same or different aldehydes. Such deodourizing materials can be: (a) an acetal or hemiacetal produced by means of reacting an aldehyde with a carbinol; (b) a ketal or hemiketal produced by means of reacting a ketone with a carbinol; (c) a cyclic triacetal or a mixed cyclic triacetal of at least two aldehydes, or a mixture of any of these acetals, hemiacetals, ketals, hemiketals, or cyclic triacetals. These deodorizing perfume materials are described in more detail in WO 01/07095 incorporated herein by reference.

Flavanoids can also be used as anti-malodour component. Flavanoids are compounds based on the C6-C3-C6 flavan skeleton. Flavanoids can be found in typical essential oils. Such oils include essential oil extracted by dry distillation from needle leaf trees and grasses such as cedar, Japanese cypress, *Eucalyptus*, Japanese red pine, dandelion, low striped bamboo and cranesbill and can contain terpenic material such as alpha-pinene, beta-pinene, myrcene, phencone and camphene. Also included are extracts from tea leaf. Descriptions of such materials can be found in JP 02284997 and JP 04030855 incorporated herein by reference.

Metallic salts can also be used as anti-malodour components for malodour control benefits. Examples include metal salts of fatty acids. Ricinoleic acid is a preferred fatty acid. Zinc salt is a preferred metal salt. The zinc salt of ricinoleic acid is especially preferred. A commercially available product is TEGO Sorb A30 ex Evonik. Further details of suitable metallic salts are provided below.

Zeolites can be used as anti-malodour component. A useful class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites can have an advantage over the "high" zeolites. The intermediate zeolites have a higher affinity for amine-type odours, they are more weight efficient for odour absorption because they have a larger surface area, and they are more moisture tolerant and retain more of their odour absorbing capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100® series of zeolites from Conteka. Zeolite materials marketed under the trade name Abscents® and Smellrite®, available from The Union Carbide Corporation and UOP are also preferred. Such materials are preferred over the intermediate zeolites for control of sulfur-containing odours, e.g., thiols, mercaptans. Suitably the zeolite material has a particle size of less than about 10 microns and is present in the composition at a level of less than about 1% by weight of the composition.

Activated carbon is another suitable anti-malodour component. Suitable carbon material is a known absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®. Suitably the activated carbon preferably has a particle size of less than about 10 microns and is present in the anti-malodour composition at a level of less than about 1% by weight of the anti-malodour composition.

Exemplar anti-malodour components are as follows.

ODOBAN™ is manufactured and distributed by Clean Central Corp. of Warner Robins, Ga. Its active ingredient is alkyl (C14 50%, C12 40% and C16 10%) dimethyl benzyl ammonium chloride which is an antibacterial quaternary ammonium compound. The alkyl dimethyl benzyl ammonium chloride is in a solution with water and isopropanol. Another product by Clean Control Corp. is BIOODOUR CONTROL™ which includes water, bacterial spores, alkylphenol ethoxylate and propylene glycol.

ZEOCRYSTAL FRESH AIR MIST™ is manufactured and distributed by Zeo Crystal Corp. (a/k/a American Zeolite Corporation) of Crestwood, Ill. The liquid comprises chlorites, oxygen, sodium, carbonates and citrus extract, and may comprise zeolite.

The anti-malodour component may comprise a malodour counteractant as described in US2005/0113282A1 by which is hereby incorporated by reference. In particular this malodour counteractant may comprise a mixture of zinc ricinoleate or a solution thereof and a substituted monocyclic organic compound as described at page 2, paragraph 17 whereby the substituted monocyclic organic compound is in the alternative or in combination one or more of:

1-cyclohexylethan-1-yl butyrate;

1-cyclohexylethan-1-yl acetate;

1-cyclohexylethan-1-ol;

1-(4'-methylethyl) cyclohexylethan-1-yl propionate; and

2'-hydroxy-1'-ethyl(2-phenoxy)acetate.

Synergistic combinations of malodour counteractants as disclosed at paragraphs 38-49 are suitable, for example, the compositions comprising:

(i) from about 10 to about 90 parts by weight of at least one substituted monocyclic organic compound-containing material which is:

(a) 1-cyclohexylethan-1-yl butyrate having the structure:

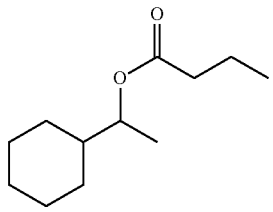

(b) 1-cyclohexylethan-1-yl acetate having the structure:

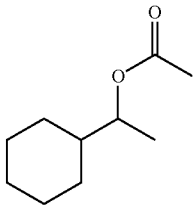

(c) 1-cyclohexylethan-1-ol having the structure:

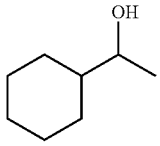

(d) 1-(4'-methylethyl)cyclohexylethan-1-yl propionate having the structure:

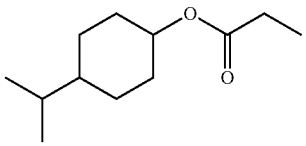

and (e) 2'-hydroxy-1'-ethyl(2-phenoxy)acetate having the structure:

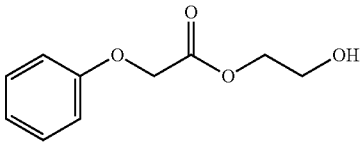

and (ii) from about 90 to about 10 parts by weight of a zinc ricinoleate-containing composition which is zinc ricinoleate and/or solutions of zinc ricinoleate containing greater than about 30% by weight of zinc ricinoleate. Preferably, the aforementioned zinc ricinoleate-containing compositions are mixtures of about 50% by weight of zinc ricinoleate and about 50% by weight of at least one 1-hydroxy-2-ethoxyethyl ether of a More specifically, a preferred composition useful in combination with the zinc ricinoleate component is a mixture of:

(A) 1-cyclohexylethan-1-yl butyrate;

(B) 1-cyclohexylethan-1-yl acetate; and (C) 1-(4'-methylethyl)cyclohexylethan-1-yl propionate.

More preferably, the weight ratio of components of the immediately-aforementioned zinc riconoleate-containing mixture is one where the zinc ricinoleate-containing composition: 1-cyclohexylethan-1-yl butyrate: 1-cyclohexylethan-1-yl acetate: 1-(4'-methylethyl)-cyclohexylethan-1-yl propionate is about 2:1:1:1.

Another preferred composition useful in combination with the zinc ricinoleate component or solution is a mixture of:

(A) 1-cyclohexylethan-1-yl acetate; and (B) 1-(4'-methylethyl)cyclohexylethan-1-yl propionate.

More preferably, the weight ratio of components of the immediately-aforementioned zinc riconoleate mixture is one where the zinc ricinoleate-containing composition: 1-cyclohexylethan-1-yl acetate: 1-(4'-methylethyl)cyclohexylethan-1-yl propionate is about 3:1:1.

To the extent any material described herein as an anti-malodour component might also be classified as another component described herein, for purposes of the present invention, such material shall be classified as an anti-malodour component.

Suitably the anti-malodour composition contains solvent and/or plasticizer. Solvents and plasticizers act to aid the natural ability of water to plasticize fibers. Acceptable solvents and plasticizers include compounds having from one to ten carbons. The following non-limiting classes of compounds are suitable: mono-alcohols, dials, polyhydric alcohols, ethers, ketones, esters, organic acids, and alkyl glyceryl ethers, and hydrocarbons.

Preferred solvents are soluble in water and/or miscible in the presence of optional surfactant. Examples include methanol, ethanol, isopropanol, hexanol, 1,2-hexanediol, hexylene glycol, (e.g. 2-methyl-2,4-pentanediol), isopropylene glycol (3-methyl-1,3-butanediol), 1,2-butylene glycol, 2,3-butylene glycol, 1,3-butylene glycol, 1,4-butylene glycol, 1,3-propylene glycol, 1,2-propylene glycol, isomers of cyclohexanedimethanol, isomers of propanediol, isomers of butanediol, the isomers of trimethylpentanediol, the isomers of ethylmethylpentanediol, alcohol ethoxylates of 2-ethyl-1,3-hexanediol, 2,2,4-trimethyl-1,3-pentanediol, alcohol ethoxylates of 2,2,4-trimethyl-1,3-pentanediol glycerol, ethylene glycol, diethylene glycol, dipropylene glycol, sorbitol, butoxy ethoxy ethanol, 3-methyl-3-methoxybutanol, 3-methoxybutanol, I-ethoxy-2-propanol, diethylene glycol monoethyl ether, diethylene glycol monopropyl ether, diethylene glycol monobutyl ether, triethylene glycol monoethyl ether, erythritol, and mixtures of solvents and plasticizers. When solvent is used, it is typically present at a level selected from at least 0.5%, at least 1%, at least 2%, at least 3%, and at least 4% by weight of the anti-malodour composition. Suitably it is present at a level selected from less than 30%, less than 25%, less than 20%, and less than 15% by weight of the anti-malodour composition.

To the extent any material described herein as an anti-malodour component might also be classified as another component described herein, for purposes of the present invention, such material shall be classified as an anti-malodour component.

Deposition Aids

The anti-malodour composition may comprise deposition aid. As used herein, a "deposition aid" is a material that assists another material (e.g., anti-malodour component/s) to deposit (e.g., adhere) to a targeted substrate. The term "deposition aid" is broad enough to encompass both polymeric deposition aids (i.e. "deposition polymer") and non-polymeric deposition aids.

Polymeric deposition aid/s are suitably present at a level of from 0.01 to 5% by total weight of the composition preferably from 0.02 to 3%, more preferably from 0.2 to 2% and most preferably from 0.5 to 1.6%. Polymeric deposition agent suitable for use in the present invention include modified natural polymers and synthetic polymers.

Polymers suitable are disclosed in WO9709406, particularly high MW polyethylene oxides (PEO) which are used to deposit clay particles in the main wash; EP0299575B1 and WO9527037 disclose high MW PEO, polyacrylates, polyacryl amides, poly vinyl alcohol and poly ethylene imines, and EP0387426B1 which utilizes a similar list of polymers as well as guar gums.

Preferred synthetic polymers, for use as a deposition aid, may be selected from the group consisting of polyethylene oxide (PEO), polyethylene imine (PEI), poly (acrylate), poly (acrylamide), polyethylene terephthalate-polyoxyethylene terephthalate (PET/POET) polymers and mixtures thereof.

The deposition aid may comprise a polysaccharide. The polysaccharide preferably has a β-1,4-linked backbone. Preferably the polysaccharide is a cellulose, a cellulose derivative, or another β-1,4-linked polysaccharide having an affinity for cellulose, such as polymannan, polyglucan, polyglucomannan, polyxyloglucan and polygalactomannan or a mixture thereof. More preferably, the polysaccharide is selected from the group consisting of polyxyloglucan and polygalactomannan.

Highly preferred polysaccharides are selected from locust bean gum, tamarind gum, xyloglucan, non-ionic guar gum, cationic starch and mixtures thereof. Most preferably, the deposition aid is locust bean gum.

The polysaccharide may be straight or branched. Many naturally occurring polysaccharides have at least some degree of branching, or at any rate at least some saccharide rings are in the form of pendant side groups (which are therefore not in themselves counted in determining the degree of substitution) on a main polysaccharide backbone. Preferably, the polysaccharide is present at levels of between 0.1% to 10% w/w by weight of the total amount of the particle.

Suitable examples of cationic polymers include cationic guar polymers such as Jaguar (ex Rhone Poulenc), cationic cellulose derivatives such as Celquats (ex National Starch), Flocaid (ex National Starch), cationic potato starch such as Softgel (ex Aralose) and cationic polyacrylamides such as PCG (ex Allied Colloids). Suitable non-ionic deposition aids include high molecular weight polyethylene glycols, for example PEO WSRN 750 (ex Union Carbide).

(vi) Perfume Ingredient Composition

Perfume ingredient compositions may be provided either as a free oil and/or in a microcapsule. They may be added as a booster on demand to an already perfumed recipe. Alternatively a recipe may comprise perfume only.

The perfume ingredient composition may be used as a light refresh treatment for articles which have not been worn for long periods of time and do not need cleaning. Advantageously, with the computer implemented method of the invention, the consumer may design the laundering for such a garment using a smartphone, in the bedroom or dressing room, immediately after the garment has been removed. The method may accordingly comprise a step of advising that only a refresh wash is suggested, for example a perfume only refresh wash. They may also be advised as part of the method, (by a GUI message) not to place the garment in the laundry basket along with dirtier items. The refresh recipe may also comprise anti-malodour agents and or care benefit agents as herein described. The perfume ingredient compositions may be in the form of a mixture or free perfumes compositions, a mixture of encapsulated perfume compositions or a mixture of encapsulated and free oil perfume compositions.

Preferred perfume components include materials of both natural and synthetic origin. They include single compounds and mixtures.

Free oil perfumes and fragrances may be included, e.g., to scent the serum, to provide scent in the washing process or to provide scent to the textiles after the wash.

Particularly preferred perfume components are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

Preferably the perfume ingredient composition comprises three or more, preferably four or more, more preferably five or more, most preferably six or more different perfume components. An upper limit of 300 perfume ingredients may be applied.

Free perfume may preferably be present in an amount from 0.01 to 50% by weight of the perfume ingredient composition.

When perfume components are in a microcapsule, suitable encapsulating material, may comprise, but are not limited to; aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations thereof. Perfume components contained in a microcapsule may comprise odiferous materials and/or pro-fragrance materials.

Particularly preferred perfume components contained in a microcapsule are blooming perfume components and substantive perfume components. Blooming perfume components are defined by a boiling point less than 250° C. and a Log P greater than 2.5. Substantive perfume components are defined by a boiling point greater than 250° C. and a Log P greater than 2.5. Preferably a perfume composition will comprise a mixture of blooming and substantive perfume components. The perfume composition may comprise other perfume components.

A plurality of perfume components may be present in a microcapsule. In the compositions for use in the present invention it is envisaged that there will be three or more, preferably four or more, more preferably five or more, most preferably six or more different perfume components in a microcapsule. An upper limit of 300 perfume ingredients may be applied.

Encapsulated perfume may preferably be present in an amount from 0.01 to 50% by total weight of the perfume ingredient composition.

If the perfume comprises microcapsules, a structurant may be required, non-limiting examples of suitable structurants include: pectine, alginate, arabinogalactan, carageenan, gellan gum, xanthum gum, guar gum, acrylates/acrylic polymers, water-swellable clays, fumed silicas, acrylate/aminoacrylate copolymers, and mixtures thereof. Preferred dispersants herein include those selected from the group consisting of acrylate/acrylic polymers, gellan gum, fumed silicas, acrylate/aminoacrylate copolymers, water-swellable clays, and mixtures thereof. Preferably a structurant is selected from acrylate/acrylic polymers, gellan gum, fumed silicas, acrylate/aminoacrylate copolymers, water-swellable clays, and mixtures thereof.

When present, a structurant is preferably present in an amount of 0.001-10 w.t. % percent, preferably from 0.005-5 w.t. %, more preferably 0.01-1 w.t. %.

(vii) Care and/or Refresh Ingredient Compositions

Care compositions preferably provide some form of care and/or refresh benefit to the fabric. They may be added to cleaning based recipes (with surfactant and enzyme for example) or they may be used alone e.g. as refresh recipe as described above. This benefit is normally a perceivable benefit which the consumers desire, for example effecting the feel, appearance, or perception of a fabric. They may be provided separately or in combinations.

Non-limiting examples of suitable benefit agents include: lubricants (including silicones), antifoams, free perfumes and fragrances, encapsulated perfumes and fragrances, insect repellents, whiteness agents (e.g. shading or hueing dyes and/or fluorescers), preservatives (e.g. bactericides), enzymes (e.g. protease, lipases, cellulases, pectate lyase), dye transfer inhibitors, pH buffering agents, perfume carriers, anti-bacterial agent, fibre adhesives (e.g. starch, Polyvinyl acetate), elastomers, anti-microbial agents, anti-redeposition agents, soil-release agents, softening agents, polyelectrolytes, anti-shrinking agents, anti-wrinkle agents, anti-oxidants, dyes, colorants, shade enhancers, fluorescent agents, sunscreens, anti-corrosion agents, anti-static agents, sequestrants (preferably HEDP, an abbreviation for Etidronic acid or 1-hydroxyethane 1,1-diphosphonic acid), colour preservatives, fungicides and ironing aids.

Preferred benefit agents are: lubricants (including silicones), fibre adhesives (e.g. starch, Polyvinyl acetate), elastomers, free perfumes and fragrances, encapsulated perfumes and fragrances and or perfume carriers, insect repellents, whiteness agents (e.g. shading or hueing dyes and/or fluorescers), enzymes (e.g. protease, lipases, cellulases, pectate lyase), dye transfer inhibitors, soil-release agents, anti-shrinking agents, anti-wrinkle agents, dyes (including colorants and/or shade enhancers), sunscreens (including UV filters), anti-static agents, sequestrants (preferably HEDP, an abbreviation for Etidronic acid or 1-hydroxyethane 1,1-diphosphonic acid) or polyelectrolytes.

Particularly preferred benefit agents include: lubricants, free perfumes and encapsulated perfumes. Most preferably silicones, free perfumes and encapsulated perfumes.

Lubricants:

Lubricants may be silicone based lubricants or non-silicone based lubricants. Examples of non-silicone based lubricants include clays, waxes, polyolefins, sugar polyesters, synthetic and natural oils. For the purposes of this invention, lubricants do not include fabric softening quaternary ammonium compounds.

Preferably the lubricant is a silicone based lubricant. Preferably the silicones comprise fabric softening silicones. Non-limiting examples of such silicones include: non-functionalised silicones such as polydialkylsiloxanes, particularly polydimethylsiloxane (PDMS), alkyl (or alkoxy) functionalised silicones, and functionalised silicones or copolymers with one or more different types of functional groups such as amino, phenyl, polyether, acrylate, siliconhydride, carboxy acid, phosphate, betaine, quarternized nitrogen and mixtures thereof.

The molecular weight of the silicone is preferably from 1,000 to 500,000, more preferably from 2,000 to 250,000 even more preferably from 5,000 to 100,000.

The silicone composition of the current invention may be in the form of an emulsion or as a silicone fluid. In a preferred embodiment the silicone is in the form of a silicone emulsion.

When the silicone is in an emulsion, the particle size is preferably in the range from about 1 nm to 100 microns and preferably from about 10 nm to about 10 microns including microemulsions (<150 nm), standard emulsions (about 200 nm to about 500 nm) and macroemulsions (about 1 micron to about 20 microns).

The silicones may be an emulsion or a fluid, preferably an emulsion.

Preferred non-functionalised silicones are polydialkylsiloxanes, most preferred non-functionalised silicones are polydimethylsiloxane (PDMS). Preferred functionalised silicones are an anionic functionalised silicone. Examples of fabric softening anionic silicones suitable for the current invention include silicones containing the following functionalities; carboxylic, sulphate, sulphonic, phosphate and/or phosphonate functionality. Preferably the anionic silicones of the current invention comprise silicones having a functionality selected from; carboxylic, sulphate, sulphonic, phosphate and/or phosphonate functionality or mixtures thereof. More preferably the anionic silicone of the present invention comprises carboxyl functionalised silicones. Most preferably the anionic silicone of the current invention is a carboxyl silicone.

For the purposes of the current invention, the anionic silicone may be in the form of the acid or the anion. For example for a carboxyl functionalised silicone, may be present as a carboxylic acid or carboxylate anion. An example of a commercially available anionic functional material is: X22-3701E from Shin Etsu and Pecosil PS-100 from Pheonix Chemical. Preferably the anionic silicone has an anionic group content of at least 1 mol %, preferably at least 2 mol %.

The anionic group(s) on the anionic silicones of the present invention are preferably located in pendent positions on the silicone i.e. the composition comprises anionic silicones wherein the anionic group is located in a position other than at the end of the silicone chain. The terms 'terminal position' and 'at the end of the silicone chain' are used to indicate the terminus of the silicone chain.

When the silicones are linear in nature, there are two ends to the silicone chain. In this case the anionic silicone preferably contains no anionic groups located on a terminal position of the silicone.

When the silicones are branched in nature, the terminal position is deemed to be the two ends of the longest linear silicone chain. Preferably no anionic functionality is not located on the terminus of the longest linear silicone chain.

Preferred anionic silicones are those that comprise the anionic group at a mid-chain position on the silicone. Preferably the anionic group(s) of the anionic silicone are located at least five Si atoms from a terminal position on the silicone. Preferably the anionic groups are distributed randomly along the silicone chain.

Most preferably the silicone of the present invention is selected from polydimethylsiloxane (PDMS) and carboxy functionalised silicones, preferred carboxy silicones are described above.

When a silicone is present, preferably the serum comprises silicone at a level of 1 to 60 w.t % of the formulation, preferably 2 to 30 w.t. % of the formulation, more preferably 2.5 to 20 w.t. % of the formulation.

The care serum may comprise a deposition aid as above described under section (vi)

Figure 2:
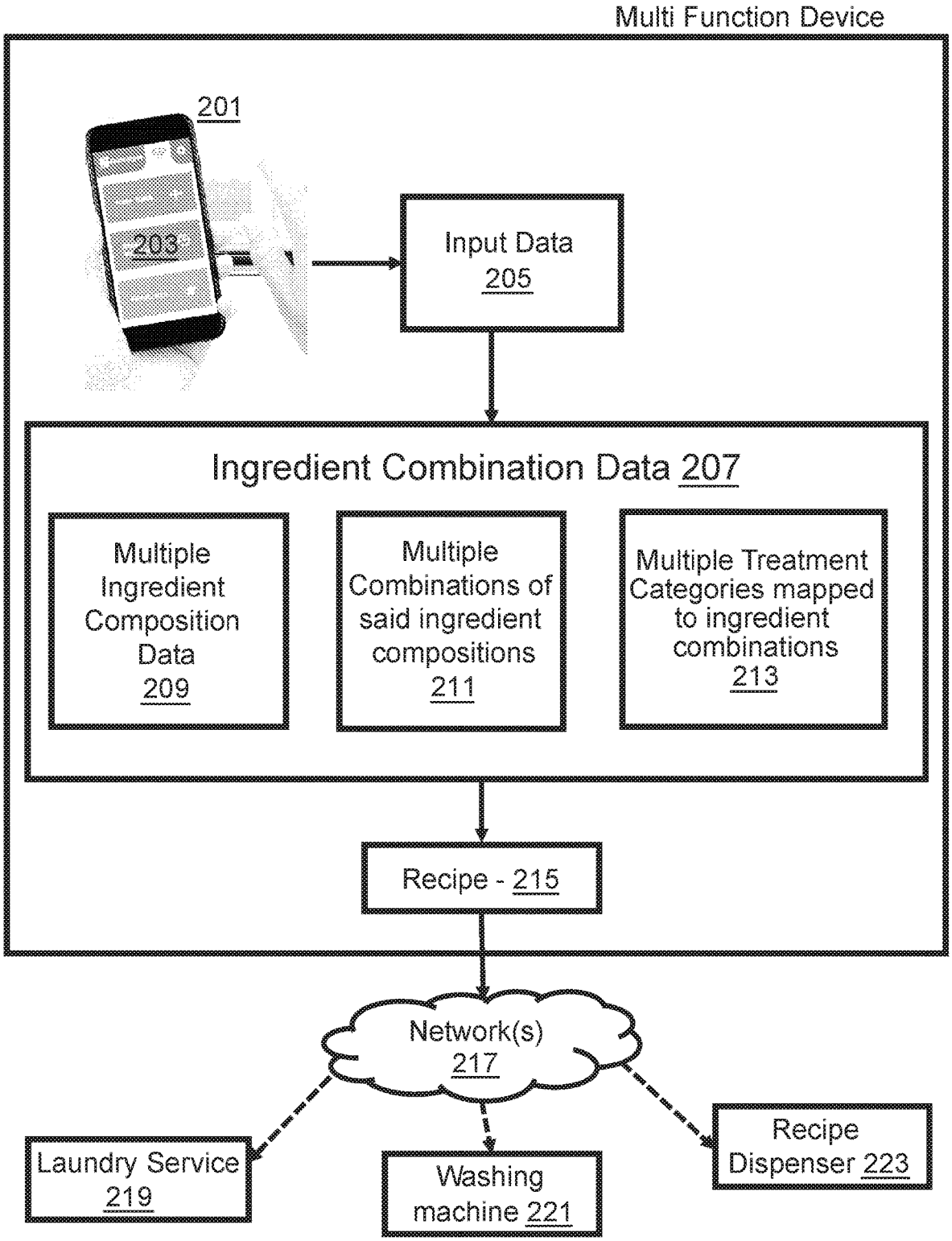
Figure 3:
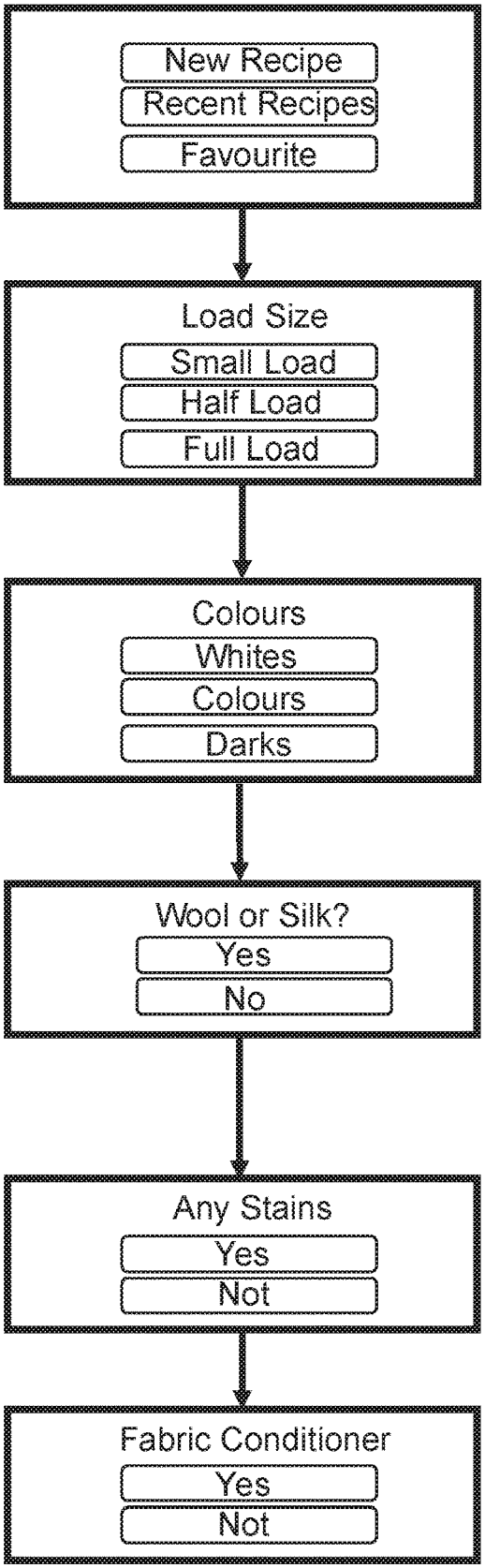
Figure 5A:
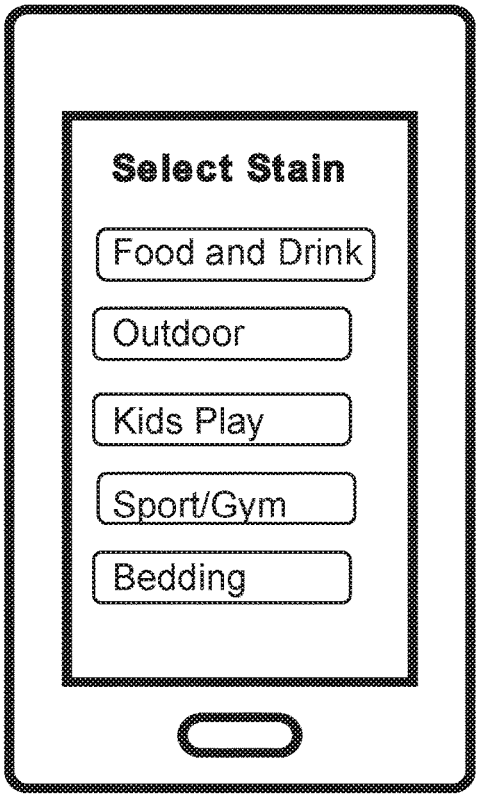
Figure 5B:
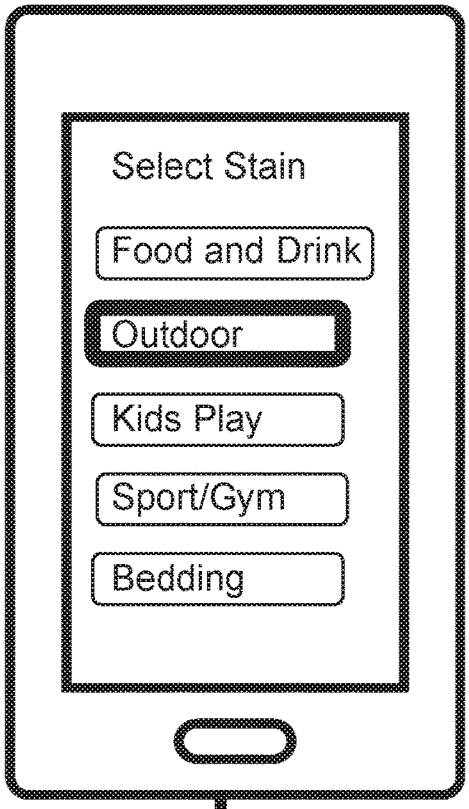
Figure 5C:
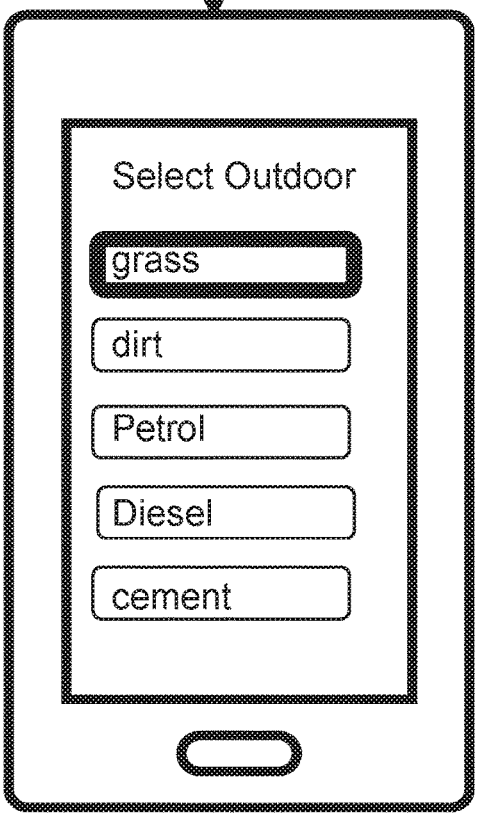
Figure 6:
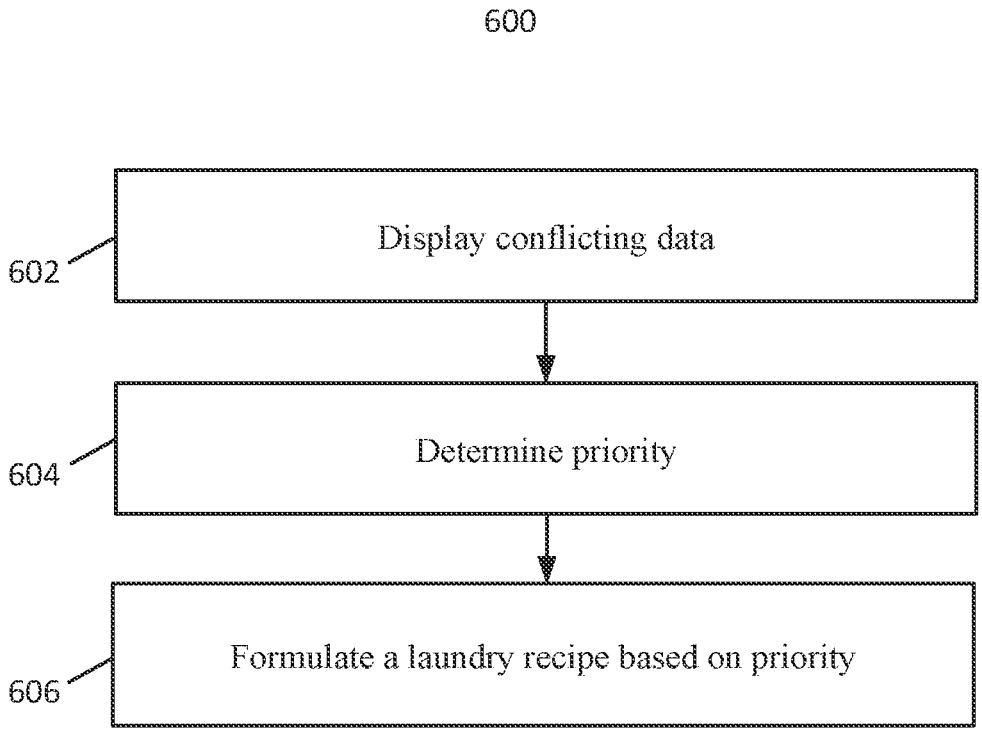

Various non-limiting embodiments of the present invention will now be described by way of example only and with reference to the following drawings in which;

FIG. 1: shows a general schematic of a method of creating a laundry product recipe;

FIG. 2: shows a more detailed schematic of the method of FIG. 1;

FIG. 3: shows a specific example of user data input;

FIGS. 4*a*-4*j*: show example user interfaces for the method of the invention;

FIGS. 5*a*-5*c*: shows example user interfaces for user selection of stain by category; and FIG. 6: shows a method of conflict resolution.

Referring to FIG. 1, this shows a schematic of one example of a method of creating a laundry product recipe. The computer-implemented method 10 shown in FIG. 1 for creating a bespoke laundry treatment recipe comprises the steps: display fabric data (step 12), receive input of fabric data (step 14), compare user input with ingredient composition data (step 16); formulate treatment recipe (step 18), and display treatment recipe (step 20).

The display steps 12 and 20 are optional in some embodiments of the method 10, and it is not always necessary for any data to be displayed to a user, e.g., when data is simply collected and transmitted to be used in formulating the recipe and a user prefers to see little to no data. If displayed, a graphical user interface (GUI) or any other user interface such as a display screen of a smart phone (see FIG. 3, 5) may be used.

Fabric data can be a variety of different data depending on systems, user preferences, etc., and can be, for example, based the following criteria:

(I) stain identity;

(ii) fabric identity;

(iii) user requirements; and (iv) user preferences.

Each of these categories are discussed in detail above, and should be understood to comprise any data related to the fabric, user, machine and/or washing conditions which can be used to help formulate a bespoke laundry product recipe.

Receiving fabric data input (step 14) can be from direct input by a user, previously recorded input, input collected by other electronic devices and transmitted (automatically or manually) or any other method available for receiving input related to fabric data. The data may be displayed, which can enable the user to review data for accuracy and completeness and correct any mistakes or earlier input preferences which are desired to be changed. This display can be in a number of different forms and/or locations, and can allow a user to directly interact with the data or may require another device or input for changing any data.

Comparing input with ingredient data composition (step 16) can be done by means of a data processing system comparing said input data with ingredient combination data stored on a non-transitory computer readable storage medium to ensure that the bespoke recipe does not conflict in terms of requirements and/or preferences. If there is a conflict, a conflict resolution method (see FIG. 6) can be performed.

After the comparison and any conflict resolution, one or more laundry treatment recipes (step 18) can be created which are individualized for the user and/or the fabrics to be laundered. The recipe may optionally be displayed (step 20).

By receiving fabric data and using this specific data to formulate a treatment recipe in combination with composition data, individualized recipes which are tailored to better treat the specific items and which comply with user preferences can be formulated. This can result in better stain treatment and wash tailored only to the levels needed and for the specific fabrics, which can increase the look and usable life of garments. Such a method can also be economical in saving resources, for example, only doing light wash or using very little components in the bespoke laundry recipe when input received indicates that a fabric is only lightly worn or used. Further, the recipe could be formulated and then transmitted to be displayed elsewhere, e.g., to a laundry service, such that another laundry service or system could formulate individualized laundry products tailored to the customer and/or fabrics.

FIG. 2 shows a more details schematic showing user data 205 input via a graphical user interphase (GUI), 203 of a smartphone 201. The smartphone 201 further comprises non-transitory computer readable storage (memory) and a processor (not shown).

Stored in memory is a recipe generator program comprising instructions which can be executed by the processor to carry out the steps of the method. Also stored in memory is the data required to implement the method: the data for displaying, and any input data including any selected data. These could also be stored remotely and transmitted to the system in some applications.

The ingredient combination data 207 comprises:

i. multiple ingredient composition data 209. This comprises multiple compositions of laundry treatment ingredients. The method of the invention combines these ingredients based on user input to design a bespoke laundry treatment recipe.

ii. multiple combinations of said ingredient compositions 211, which includes multiple combinations of the ingredient compositions (i) and also includes ingredient composition ratios (which may be by volume, weight etc.) The multiple combinations of the ingredients represent the bespoke recipes.

iii. multiple treatment (e.g. stain) categories comprise multiple stains which are mapped/related to said ingredient composition combinations 211.

In this example, the multiple ingredient compositions comprise a combination of one or more of:

(i) an ingredient composition comprising a surfactant, (ii) one or more separate ingredient composition(s) each comprising a different enzyme (iii) an ingredient composition comprising a bleach component, (iv) an ingredient composition comprising an alkaline component, (v) a perfume ingredient composition; and (vi) a care/refresh ingredient composition.

The compositions of these are as described hereinabove.

For example it may be arranged in data arrays or databases, which are used by the programme to compare input data as shown in Table 1, which shows an example array methodology used for calculating ingredient needs based on stains or stain types:

TABLE 1

Data Array

| Recipe | Ingredient Combination Data | Stain | Stain type |
|---|---|---|---|
| Recipe 1 | Ingredient composition: (i) base detergent | Stain 1 (baby oil) | Stain type 1 (cosmetics, baby) |
| Recipe 2 | Ingredient composition: (i) Ingredient composition (ii) (enzyme) | Stain 2 (jam) | Stain type 2 (food) |

Using Table 1, user input data regarding stains is compared with the Stain or Stain Type column data to identify the associated ingredient composition for the stain/stain type. If for example it is 'stain 1' which might be e.g. baby oil, then the associated ingredient is a base detergent.

In the second example, in the second row, if the stain data input by the user is jam, then the program identifies this in the Stain column and reads across to the Ingredient Combination Column where the data indicates that the combination is ingredient compositions (i) and (ii) (enzyme).

Because the recipe compositions are arranged additively, i.e., with a 'base' surfactant, and additive functional components, the array can be simplified.

The precise composition of each ingredient composition can stored in multiple ingredient composition data set. This will ideally be stored separately in, e.g., an array or arrays, containing data regarding ingredients, chemistries, suppliers, safety data, etc. These are referenced by the program if necessary (e.g., if the precise information needs to be sent to a laundry service or calibrated with ingredients in a recipe dispenser device).

The table may comprise further data with, e.g., amounts of respective ingredient compositions and/or relative ratios of respective ingredient compositions and in the case where it is to be used to activate a washing machine, the times in the wash cycle that the ingredient compositions should be dosed.

The determined recipe 215 may be transmitted by connection (wireless or wired) to the internet/network to (i) a laundry service 219 which carries out the laundry treatment operation on the user's behalf, (ii) the user's washing machine 221, or (iii) a recipe dispenser 223.

The recipe dispenser 223 may comprise an apparatus for providing laundry product(s). The apparatus can be a dosing unit and/or a dispensing device having one or more reservoirs for containing laundry product components that is located within or outside of a wash machine. Wherein the device comprises a dispensing unit, it can be controlled to selectively dispense portions of components from the reservoir(s) so as to provide a dose of laundry product in the dosing unit as a result of input by a user and the determined recipe. The dispenser may comprise a computing or controlling device itself to effect controlled dosing according to the method and/or can be controlled from a remote location.

A reservoir cartridge which may be used with a dispenser or with a washing machine itself may contain a stock of a composition in an amount sufficient for two or more doses, sometimes for three or more and in other cases, for five or more doses of laundry product. A cartridge may be disposable or be designed to be refillable and could be for inside the washing machine, inside the drum, inside another reservoir or outside a washing machine. In some cases, a cartridge may even be dissolvable.

The apparatus is configured such that the dosing unit and dispensing device are typically located externally of the washing machine, though the dosing unit may be adapted to be placed in the washing machine, especially in the washing machine drum. The dose of laundry product may also be supplied to the drum via a drawer, or other fluid connection.

In the various aspects of the invention, the dosing unit may be conventional dosing ball. Alternatively, the dosing unit may be a bottle, pouch or other receptacle. After the recipe is dispensed into the bottle, a spray head may be fitted to create a refresh spray product.

Additional water may be added to a fill-level indicator to create a sprayable composition if the ingredient compositions used require thinning.

FIG. 3 shows a detailed example of possible user data input 300. This includes input regarding i. whether a new, recent or 'favourite' recipe is to be accessed 302, ii. the load size 304, iii. fabric colour 306, iv. specific fabric type 308, v. if any stains are to be treated 310, and vi. if fabric conditioner is to be part of the treatment 312.

These are merely a number of examples of types of user input which could be a part of the system and method, and different systems would have much different input and/or input options. The amount and type of input options can be based on past collected data, known user preferences, already known fabric or user data, etc. The input format and order are also for example purposes only, and could vary greatly in different systems and methods.

The ability for a user to input data in a system such as this does allow for making individualized laundry products and recipes that are specifically tailored to the user and/or fabric to be washed. Such a system also allows a user to understand and have more control regarding preferences and laundry treatment, which can result in better laundry outcomes and/or higher customer satisfaction.

Figure 4A:
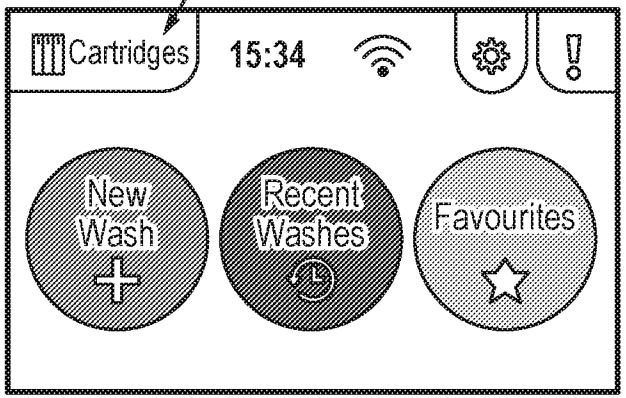
Figure 4B:
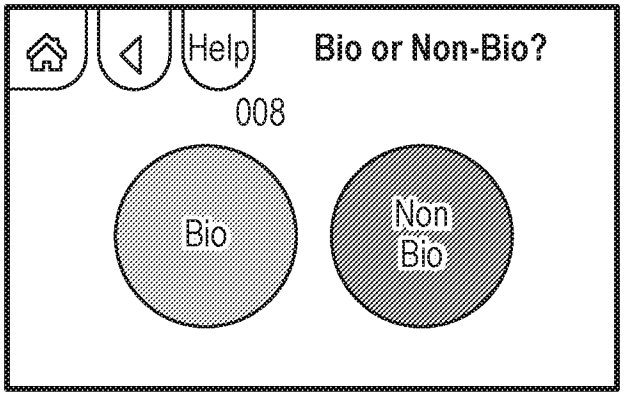
Figure 4C:
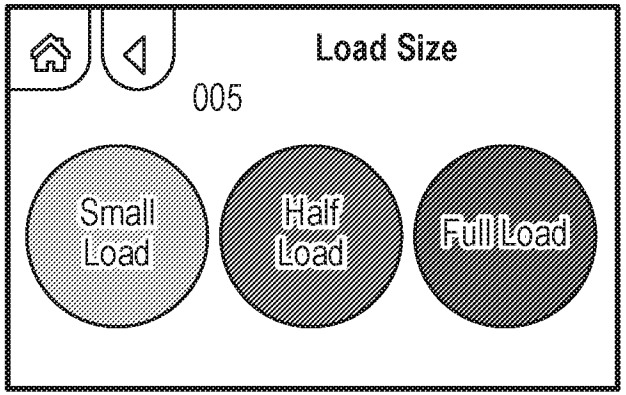
Figure 4D:
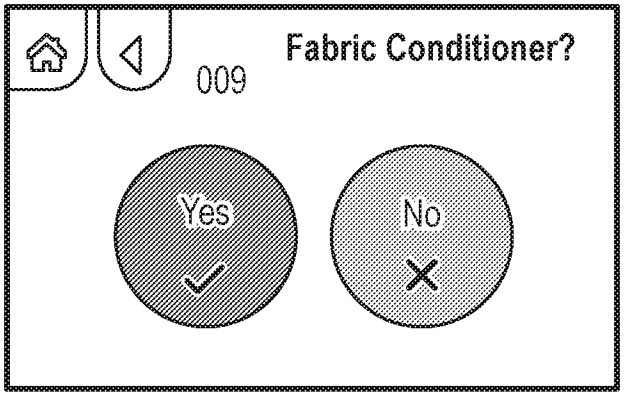
Figure 4E:
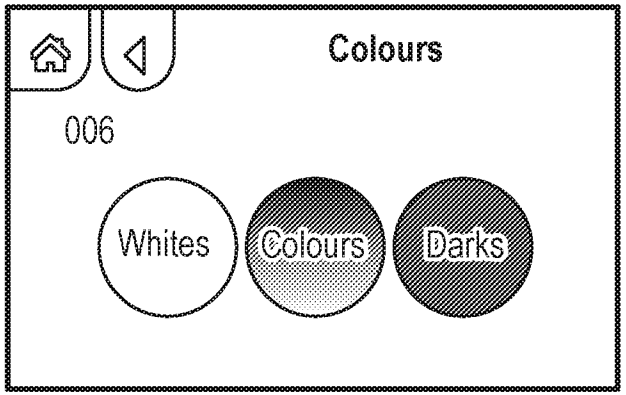
Figure 4F:
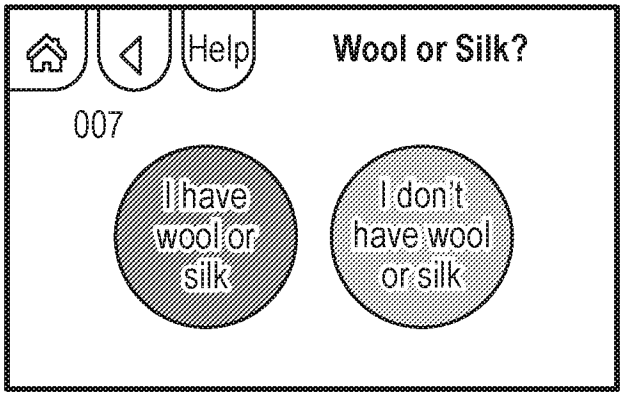
Figure 4G:
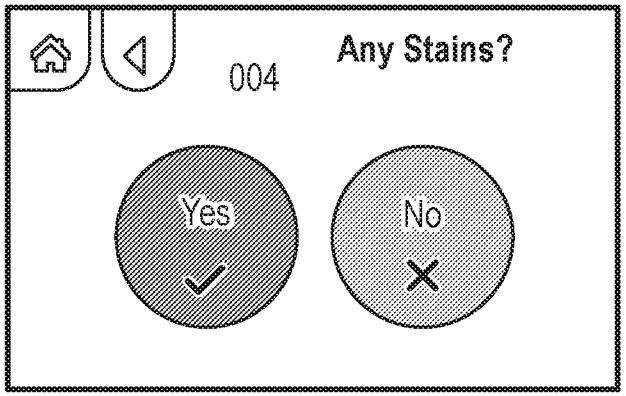
Figure 4H:
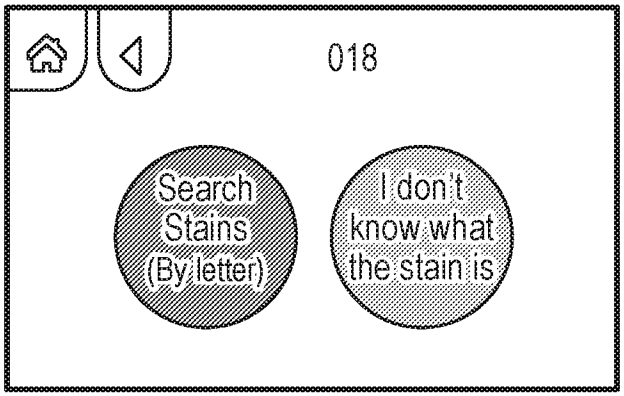
Figure 4I:
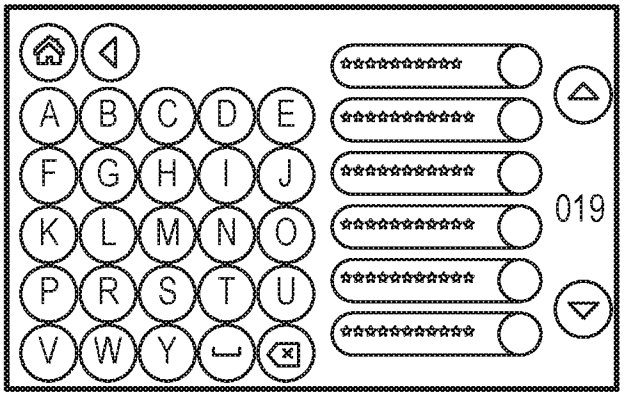
Figure 4J:
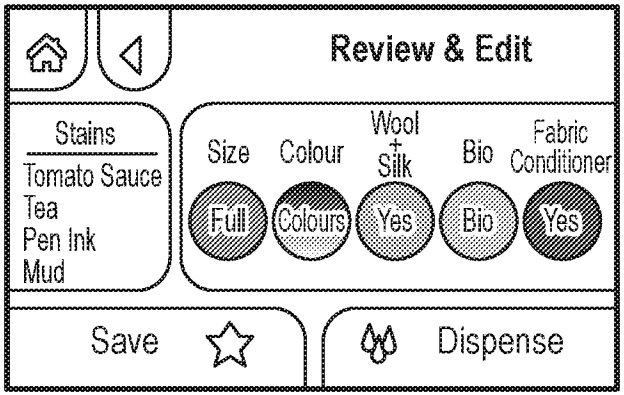

FIGS. 4*a*-4*j* show example GUIs for the method. These are similar to the user data input shown in FIG. 3, and include the screen of FIG. 4*i* for entering completely new input (as opposed to simply picking from options), and the screen shown in FIG. 4*j* for reviewing and editing the input data. In certain embodiments where the device is connected to a dispensing device, e.g., a washing machine or standalone dispenser with replaceable cartridges containing ingredient compositions, the GUI may show levels of ingredient compositions in the cartridges. An example of this is shown in FIG. 4*a* at 401.

Also shown is a signal connection strength 403 for connecting with other devices or systems, for example, a remote connection to a laundry service or for downloading updates to the software or firmware. This could be through household wi-fi, the internet, a local network, etc. In some embodiments, this could also indicate a hard wired connection, e.g., the UI could be connected to a docking station at the washing machine or another computer system for communicating and/or recharging.

FIGS. 5*a*-5*c* shows shows example GUIs for user selection of stain by category as part of the method of the invention. The user first selects the stain type from a list of types (Food and Drink, Outdoor, Kids Play, Sport/Gym, Bedding etc.), as shown in FIG. 5*a*. FIG. 5*b* shows the selection Outdoor which then may initiate a further choice from grass, dirt, petrol, diesel, cement etc. (FIG. 5*c*). The output of this user input data is then used as above to determine ingredient composition data to generate a recipe.

FIG. 6 shows an example method of conflict resolution 600, which could be implemented with methods of creating laundry treatment recipes. Method 600 includes displaying conflicting data (step 602); determining priority (step 604); and formulating a laundry recipe based on priority (step 606). Such a method is useful as part of a method which allows a user to input preferences and/or information to the system and alert a user to a situation where wash performance, safety or other performance factors may be compromised by combinations of particular components. As some users are not very knowledgeable about laundry recipe components, there will be occasions where treatment and ingredient compositions selected (or determined indirectly from user input) are not compatible. Such a situation can trigger conflict resolution method 600.

Step 602 of displaying conflicting input data can be done on a user interface, the wash machine or any other location appropriate. This can include combinations of fabric data selected by the user, compositions selected based on user input (directly or indirectly), stain identity data, fabric identity data, user requirement and/or user preferences. Displaying the conflicting data can help a user understand what is happening and why all the user input and/or preferences cannot be followed. This can help to avoid user frustrating and resulting disengagement.

Step 604 of determining priority can be based on different set rules, e.g., stain treatment always takes priority, or can be determined based on user input. If based on user input, the user could be given choices on the user interface such that they can determine the overriding priority, e.g., non-enzyme vs. stain treatment, for that wash. The user may also be given the option to save that priority, which the system would use for further conflict resolution.

Step 606 then goes on to formulate one or more bespoke laundry recipes according to the priority of step 604. Method 600 provides a method to resolve conflicts that naturally arise when users with little to no chemistry background make choices related to an individualized laundry product recipe. Such a method keeps a user informed and can give a user greater control and information to design a recipe and create a bespoke recipe despite inputs which result in initial conflicting components.

It is to be understood that the examples and embodiments described herein are for illustrative purposes and that various modifications or changes in light thereof will be suggested to a person skilled in the art and are included in the spirit and scope of the invention and the appended claims.

The invention claimed is:

1. A computer-implemented method for creating a laundry treatment recipe, the method comprising:

receiving fabric data input by a user, wherein the fabric data includes data related to one or more of a stain identity, a fabric identity, user requirements, or user preference;

determining conflicting data, by a data processing system, wherein the data processing system determines conflicting data based on conflicting data combinations within the fabric data and based on conflicting data within a comparison of the fabric data with functionality and inter-relationships of individual laundry treatment ingredients within ingredient data stored on a non-transitory computer readable storage medium;

performing conflict resolution, by the data processing system, in response to the determined conflicting data, the conflict resolution comprising:

displaying the determined conflicting data; and determining an overriding a laundry treatment and/or ingredient priority based on an input from the user or based on rules pertaining to the fabric data, the ingredient data, and the determined conflicting data;

formulating one or more laundry treatment recipes, wherein the laundry treatment recipes combine individual laundry treatment ingredients from the ingredient data according to the treatment and/or ingredient priority; and supplying a dose of laundry treatment product according to the one or more laundry treatment recipes by a controllable dispensing device, the device having multiple reservoirs, wherein each reservoir comprises an individual laundry treatment ingredient within the ingredient data, wherein the ingredient data includes:

multiple individual laundry treatment ingredients available for the laundry treatment recipe;

multiple combinations of the individual laundry treatment ingredients for the laundry treatment recipe; and multiple stain treatment categories related to the multiple combinations of the individual laundry treatment ingredients for the laundry treatment recipe.

2. The method according to claim 1, further comprising displaying one or more lists of choices from which the user may select to input the fabric data input by the user.

3. The method according to claim 2 wherein the one or more lists of choices from which the user may select are displayed according to different operating modes, each operating mode having a different list of choices from which the user may select, the method further comprising receiving a selection of a mode of operation.

4. The method according to claim 1, further comprising displaying one or more lists of individual stains to the user to select or de-select.

5. The method according to claim 1 wherein fabric data related to the stain identity is determined from one or more of user activity, location of activity, weather, dining, garment user, garment type, and user location within the data input by the user.

6. The method according to claim 1 wherein fabric data related to fabric identity is determined from one or more of user behavior, user location, location environment, and weather within the data input by the user.

7. The method according to claim 1 wherein the fabric data input by the user is transmitted from a location remote from a laundry treatment location.

* * * * *